US012042693B2

(12) United States Patent
Polinsky et al.

(10) Patent No.: US 12,042,693 B2
(45) Date of Patent: Jul. 23, 2024

(54) PORTABLE ELLIPTICAL EXERCISE DEVICE

(71) Applicant: FITNESS CUBED INC., Chicago, IL (US)

(72) Inventors: Glenn Polinsky, Vancouver, WA (US); PJ Bush, Portland, OR (US)

(73) Assignee: Fitness Cubed Inc., Chicago, IL (US)

( * ) Notice: Subject to any disclaimer, the term of this patent is extended or adjusted under 35 U.S.C. 154(b) by 131 days.

(21) Appl. No.: 17/764,439

(22) PCT Filed: Sep. 29, 2020

(86) PCT No.: PCT/US2020/053251
§ 371 (c)(1),
(2) Date: Mar. 28, 2022

(87) PCT Pub. No.: WO2021/067258
PCT Pub. Date: Apr. 8, 2021

(65) Prior Publication Data

US 2022/0362628 A1 Nov. 17, 2022

(51) Int. Cl.
*A63B 22/06* (2006.01)
*A63B 21/00* (2006.01)
(Continued)

(52) U.S. Cl.
CPC ..... *A63B 22/0664* (2013.01); *A63B 21/154* (2013.01); *A63B 21/225* (2013.01);
(Continued)

(58) Field of Classification Search
CPC . A63B 22/0664; A63B 21/154; A63B 21/225; A63B 21/4034; A63B 22/0694; A63B 22/203; A63B 21/4049; A63B 71/0036; A63B 71/0054; A63B 71/0622; A63B 2208/0233; A63B 2209/00; A63B 2209/08; A63B 2210/50; A63B 2225/09
See application file for complete search history.

(56) References Cited

U.S. PATENT DOCUMENTS 4,592,544 A * 6/1986 Smith ..... A63B 22/0605 482/901
5,013,033 A * 5/1991 Watterson ..... A63B 22/0076 482/127
(Continued)

OTHER PUBLICATIONS

International Search Report and Written Opinion for PCT/US2020/053251 dated Dec. 31, 2020, 15 pages.

*Primary Examiner* — Garrett K Atkinson
(74) *Attorney, Agent, or Firm* — Foley & Lardner LLP

(57) ABSTRACT

An exercise device comprises a base and a rotation assembly movably attached to the base. The rotation assembly comprises an exercise interface assembly comprising at least one exercise support portion configured to be moved by a user, a crank assembly comprising at least one crank rotatably attached to the at least one exercise support portion and configured to be rotated about a crank rotational axis by the at least one exercise support portion, and a flywheel assembly comprising a flywheel configured to be rotated about a flywheel rotational axis due to rotation of the at least one crank. The crank rotational axis and the flywheel rotational axis are substantially perpendicular to each other.

19 Claims, 24 Drawing Sheets

(51) Int. Cl.
*A63B 21/22* (2006.01)
*A63B 22/20* (2006.01)

(52) U.S. Cl.
CPC ..... *A63B 21/4034* (2015.10); *A63B 22/0694* (2013.01); *A63B 22/203* (2013.01)

(56) References Cited

U.S. PATENT DOCUMENTS 5,092,581 A * 3/1992 Koz ..... A63B 69/06 434/247
5,308,300 A * 5/1994 Chino ..... A63B 22/0056 601/36
5,595,554 A 1/1997 Maresh
6,063,008 A * 5/2000 McBride ..... A63B 22/0664 482/52
6,551,217 B2 * 4/2003 Kaganovsky ..... A63B 22/0605 482/57
7,022,049 B2 * 4/2006 Ryan ..... A63B 22/0664 482/52
7,037,242 B2 * 5/2006 Lo ..... A63B 22/0664 482/52
7,276,017 B2 * 10/2007 Chen ..... A63B 22/001 482/52
7,497,801 B2 3/2009 Kakinami et al.
7,594,877 B2 * 9/2009 Anderson ..... A63B 22/001 482/52
7,771,324 B2 * 8/2010 Anderson ..... A63B 21/157 482/52
7,811,206 B2 * 10/2010 Chuang ..... A63B 22/0664 482/52
7,862,484 B1 * 1/2011 Coffey ..... A63B 21/157 482/72
7,909,740 B2 3/2011 Dalebout et al.
7,918,766 B2 * 4/2011 Lu ..... A63B 22/001 482/52
8,808,149 B2 * 8/2014 Huang ..... A63B 22/0664 482/52
8,840,529 B2 * 9/2014 Chen ..... A63B 22/0664 482/52
8,870,716 B2 * 10/2014 Murray ..... A63B 21/15 482/52
8,936,535 B1 * 1/2015 Chen ..... A63B 22/001 482/52
9,067,101 B1 * 6/2015 Chuang ..... A63B 22/001
9,254,414 B2 * 2/2016 Liu ..... A63B 22/208
9,925,411 B2 * 3/2018 Huang ..... A63B 22/0664
10,022,584 B2 * 7/2018 Chang ..... A63B 22/0605
10,080,918 B2 9/2018 Dalmia
10,369,404 B2 * 8/2019 Smith ..... A63B 22/001
2003/0013581 A1 * 1/2003 Kaganovsky ..... A63B 22/0664 482/51
2003/0166438 A1 * 9/2003 Gramaccioni ..... A63B 26/003 482/72
2007/0072742 A1 * 3/2007 Chen ..... A63B 22/001 482/52
2007/0161464 A1 * 7/2007 Chiles ..... A63B 22/0664 482/52
2008/0242516 A1 * 10/2008 Lu ..... A63B 22/001 482/52
2010/0248899 A1 * 9/2010 Bedell ..... A63B 22/001 482/4
2013/0310225 A1 11/2013 Johnson
2015/0087481 A1 * 3/2015 Liu ..... A63B 22/0015 482/52
2017/0128771 A1 * 5/2017 Huang ..... A63B 22/04
2017/0216655 A1 * 8/2017 Chang ..... A63B 22/0605

* cited by examiner

PORTABLE ELLIPTICAL EXERCISE DEVICE

CROSS-REFERENCE TO RELATED PATENT APPLICATIONS

This application is a U.S. national phase application based on PCT Application No. PCT/US2020/053251, filed Sep. 29, 2020, which claims priority to and the benefit of U.S. Provisional Patent Application No. 62/908,475, filed Sep. 30, 2019, the entire disclosure of which is incorporated herein by reference.

BACKGROUND

The present application relates generally to the field of elliptical exercise devices. More specifically, this application relates to portable elliptical exercise devices that are configured to be compact and foldable.

SUMMARY

An exercise device comprises a base and a rotation assembly movably attached to the base. The rotation assembly comprises an exercise interface assembly comprising at least one exercise support portion configured to be moved by a user, a crank assembly comprising at least one crank rotatably attached to the at least one exercise support portion and configured to be rotated about a crank rotational axis by the at least one exercise support portion, and a flywheel assembly comprising a flywheel configured to be rotated about a flywheel rotational axis due to rotation of the at least one crank. The crank rotational axis and the flywheel rotational axis are substantially perpendicular to each other.

DETAILED DESCRIPTION

Figure 1:
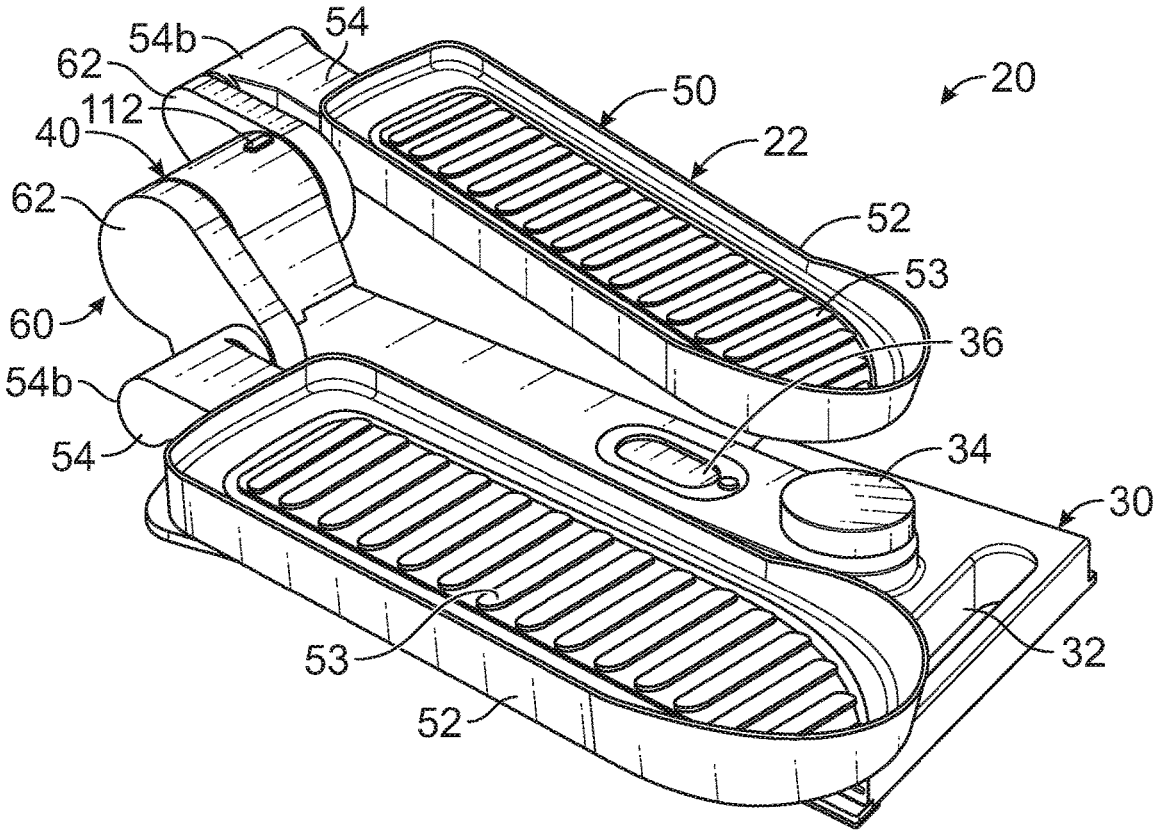
FIG. 1 is a front perspective view of an exemplary embodiment of an exercise device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Disclosed herein are portable, compact fitness equipment, such as elliptical exercise devices, that a user can use to exercise with, in particular with an elliptical motion. According to various embodiments, the exercise device allows a user to exercise while in a seated position. For example, the user may use the elliptical exercise device to exercise while sitting in a chair in a confined space, such as at a seated work space or desk. The elliptical exercise devices enable an elliptical motion for exercise and are designed to be portable by being more compact, being lighter, having a lower profile, and having a smaller footprint (compared to previous elliptical devices). According to various embodiments, however, the exercise device may be used for exercise while the user is sitting or standing, according to their desired use.

The exercise device enables a user to exercise using elliptical or rotational movement. According to one embodiment, the exercise device allows the user to exercise their legs by moving the foot pedals (as described further herein) with their feet in an elliptical motion that is guided and controlled by the exercise device. However, according to various other embodiments, the exercise device may provide the user with other types of exercise. For example, the exercise device may alternatively be configured to allow the user to exercise their arms by moving hand grips or supports (instead of foot pedals) with their hands in the elliptical motion. Furthermore, instead of an elliptical motion, the exercise device may be configured to guide other types of rotational movement (such as circular movement) of the user's arms or legs, depending on the desired configuration. Accordingly, although elliptical motion for leg exercise (in which foot pedals are used) is described herein, the exercise device may instead be used with other types of rotational motion and/or for arm exercise (in which hand grips or supports are used).

FIGS. 1-31 illustrate various exemplary embodiments of an elliptical exercise machine or device 20 that allow a user to exercise while sitting in a confined space. As described further herein, the various embodiments of the exercise device 20 include a base 30 and a rotation assembly 22 that is movably attached to the base 30. According to some embodiments (as shown in FIGS. 1-4, for example), the exercise device 20 further includes a crank support 40, as described further herein.

The rotation assembly 22 comprises an exercise interface assembly (which may be referred to as a foot pedal assembly 50), a crank assembly 60, and a flywheel assembly 90. The exercise interface assembly comprises at least one (preferably two) exercise support portion (which may be referred to as a foot pedal support 54) that is configured to be moved by a user for exercise. The crank assembly 60 comprises at least one crank 62 rotatably attached to the foot pedal support 54. Accordingly, as the user moves the foot pedal supports 54, the foot pedal supports 54 rotated the cranks 62 about a crank rotational axis 69.

The flywheel assembly 90 comprises a flywheel 96 that is configured to be rotated about a flywheel rotational axis 99 due to rotation of the cranks 62. When the exercise device 20 is in use (i.e., such that the exercise device 20 is horizontally oriented and the base 30 extends parallel to the floor along its length), the flywheel 96 extends radially horizontally. Accordingly, the flywheel rotational axis 99 extends substantially vertically (and the crank rotational axis 69 extend substantially horizontally). Accordingly, the crank rotational axis 69 and the flywheel rotational axis 99 are substantially perpendicular to each other. This configuration allows the exercise device 20 to have a compact and stable configuration, with a low center of gravity.

Figure 15:
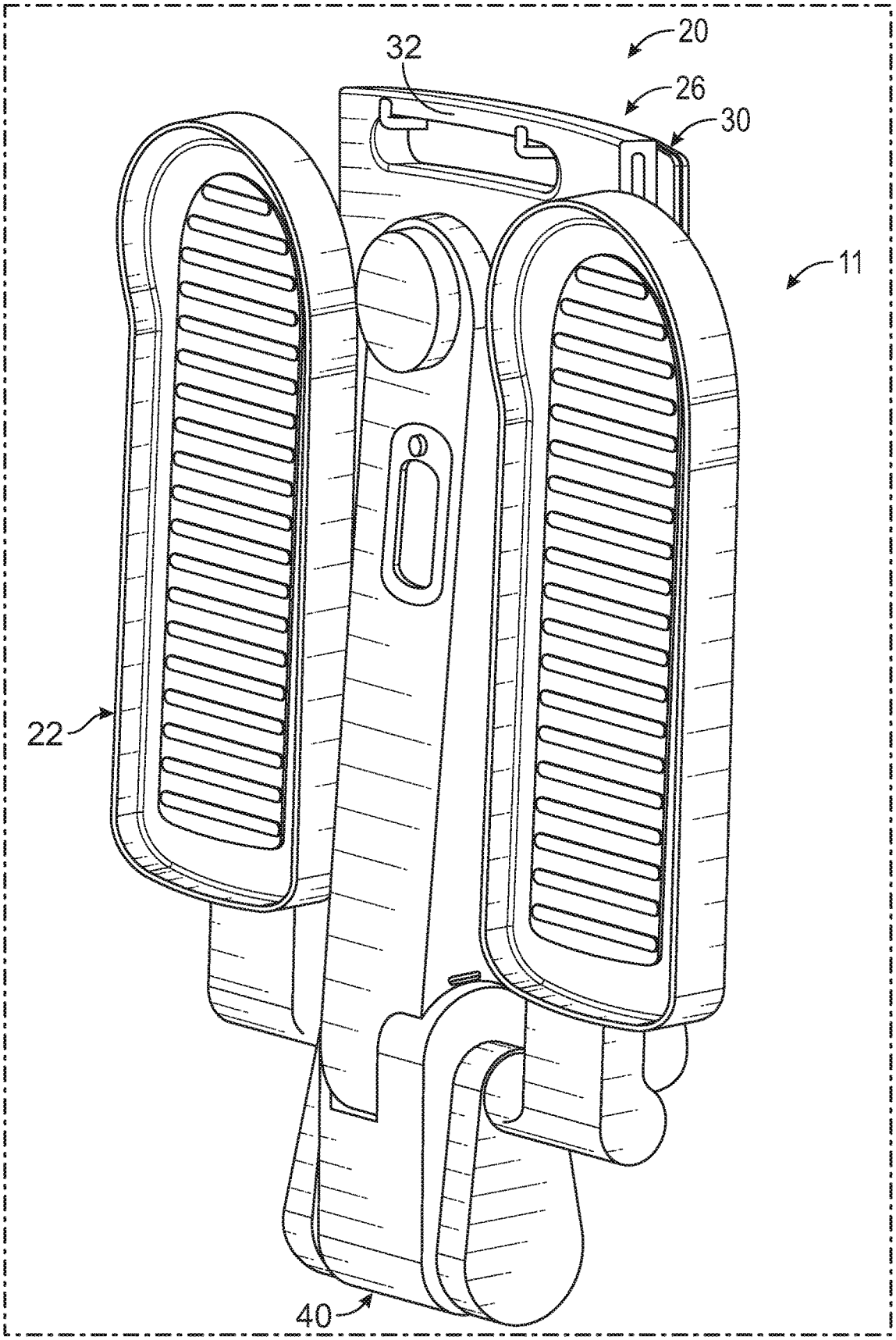
FIG. 15 is a perspective view of the exercise device of FIG. 1 hanging on a wall in the folded position.
Figure 16:
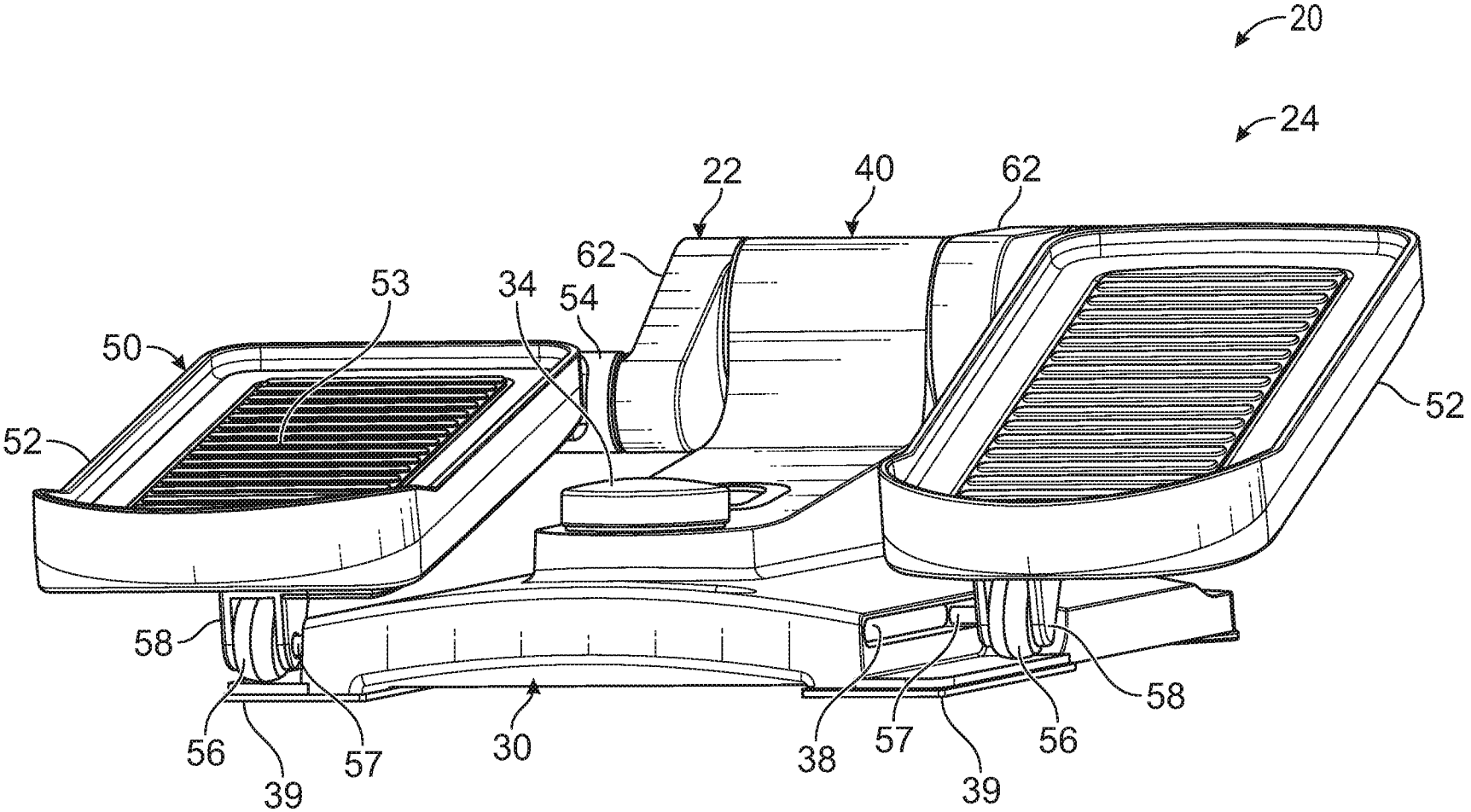
FIG. 16 is a perspective view of an exercise device according to another embodiment.
Figure 17:
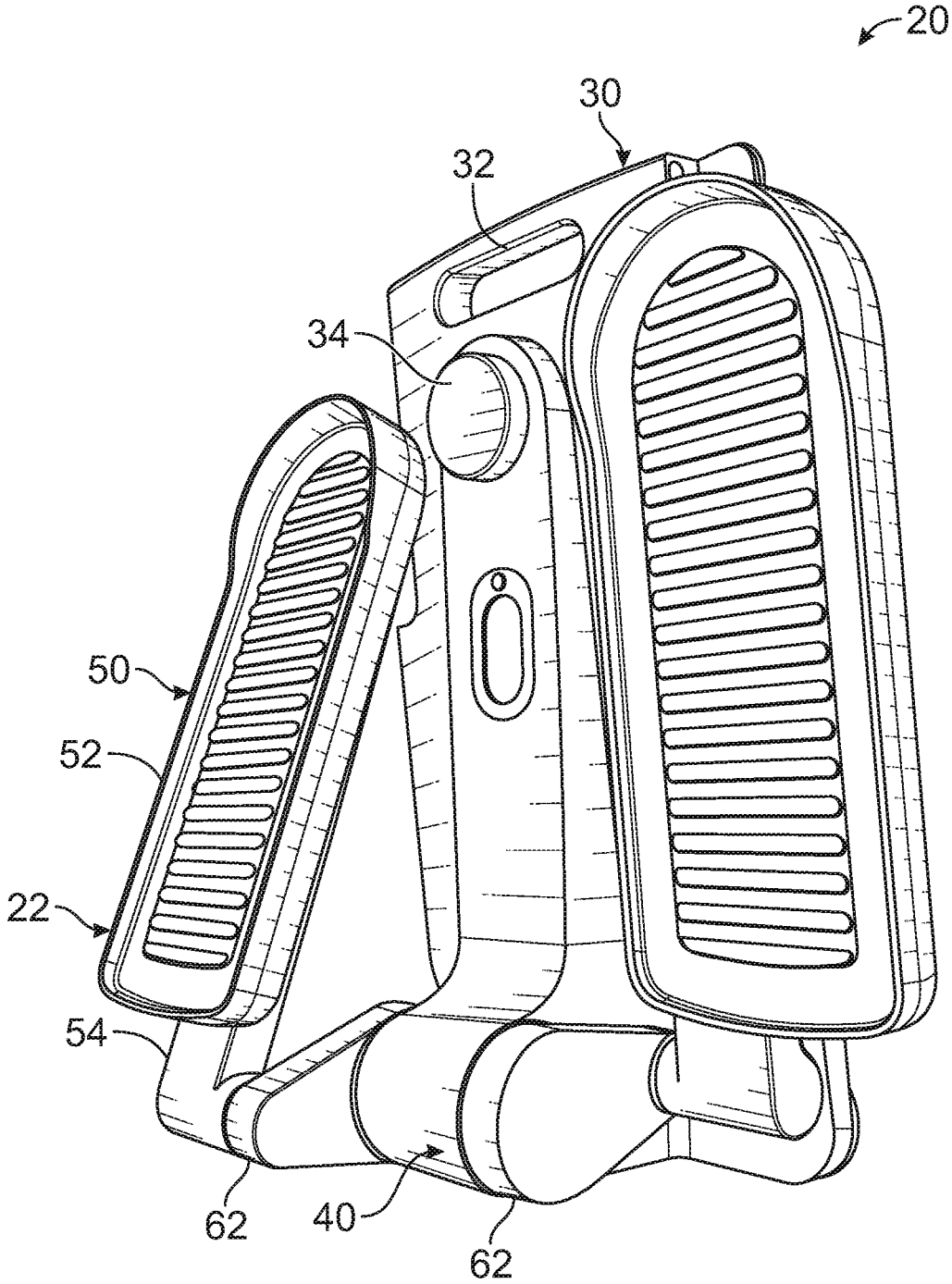
FIG. 17 is a perspective view of the exercise device of FIG. 16 in an upright, vertical position.
Figure 18:
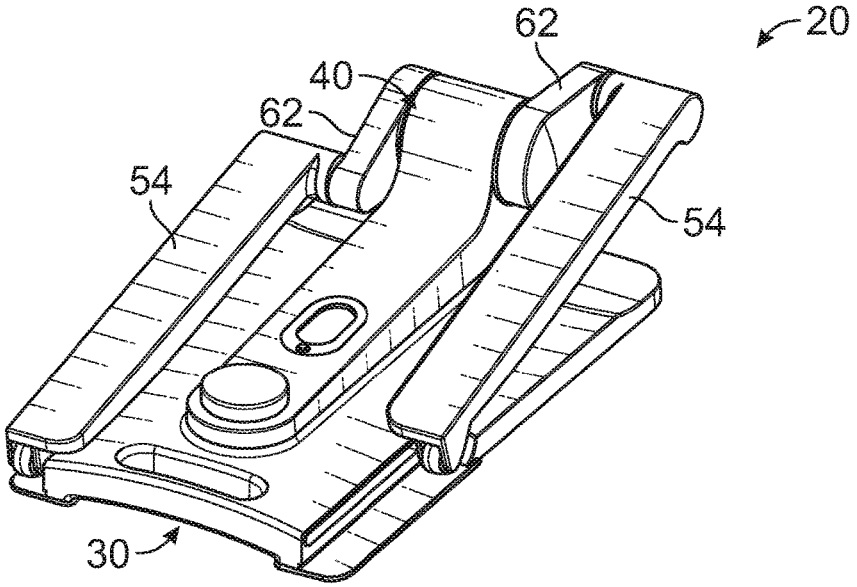
FIG. 18 is a perspective view of the exercise device of FIG. 16 with the foot pedals removed.

As described further herein, the exercise device 20 may be fully collapsible or foldable (as shown in FIGS. 1-15) or partially collapsible or foldable (as shown in FIGS. 16-17) for shipping and/or storage. The number of belts within the exercise device 20 may vary depending on the configuration. For example, as shown in FIGS. 3-4 and 22-24, the exercise device 20 includes only three belts, as described further herein. However, as shown in FIGS. 27-31, the exercise device 20 includes only two belts, as described further herein.

Figure 2:
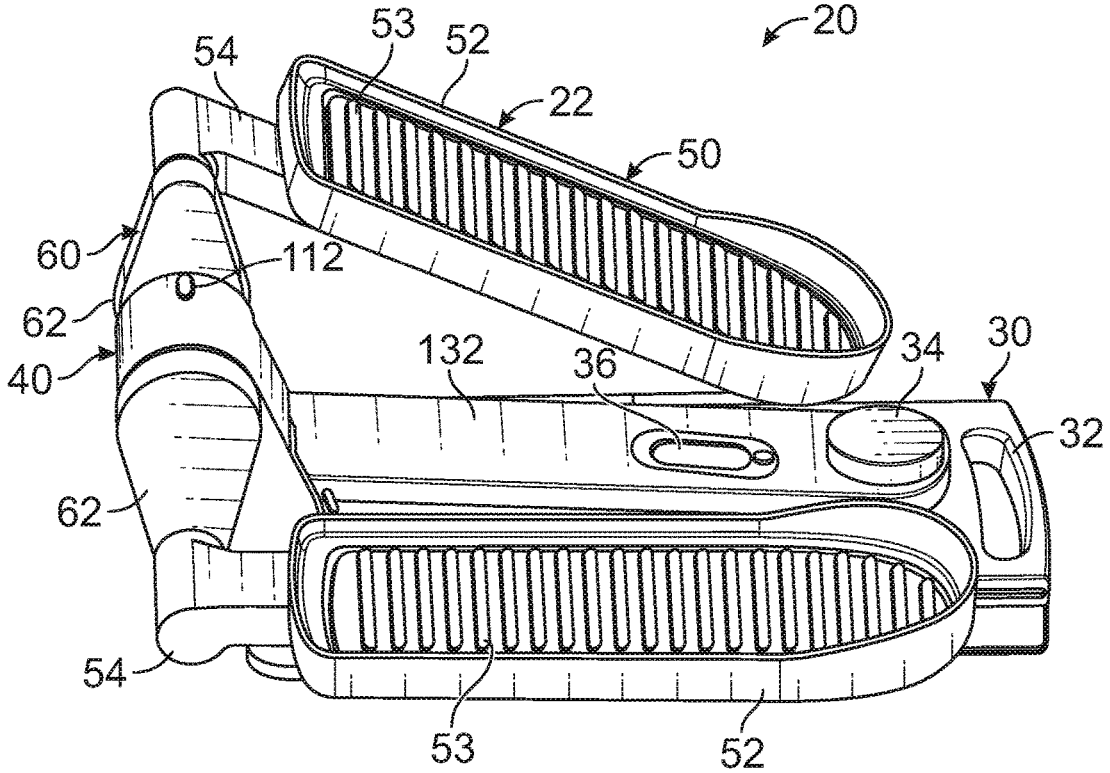
FIG. 2 is a side view of the exercise device of FIG. 1.

As shown in FIGS. 1-2, the base 30 stabilizes the exercise device 20 along the ground or floor while in use and provides an area for the rotation assembly 22 to move relative to and attach to. The base 30 may have a "clamshell" configuration in which two halves are joined together along a hinge or seam.

As shown in FIGS. 5-10, the base 30 defines at least one (preferably two) longitudinal groove or slot 38 extending along at least a portion of the longitudinal length of the base 30. The two slots 38 may be positioned along opposite sides of the base 30 along the width of the base 30 to correspond to the two foot pedal supports 54. As described further herein, the slots 38 are configured to receive and secure (and optionally guide) an extension 57 (see, e.g., FIG. 16) of the foot pedal support 54, in particular while the exercise device 20 is being stored in a vertical position or orientation.

According to one embodiment, the slots 38 may optionally help guide the movement of the foot pedals 52 as a sliding contact point. For example, during exercise use, the slots 38 keep the end of the foot pedals 52 (in particular the extension 57 and the wheels 56) at the same height along the bottom of the base 30 throughout the entire rotational movement of the foot pedals, which creates an angle between the foot pedal 52 and the floor while the front of the foot pedal 52 is positioned upward. According to another embodiment, although the extension 57 moves back and forth within the slot 38 during normal use, the extension 57 does not engage with the slot 38 during normal use (and only engages during storage when the exercise device 20 is positioned vertically upright, as described further herein). Instead, the wheel 56 carries the load of the foot pedal 52 and the foot pedal support 54.

As shown in FIGS. 5-10, the base 30 includes at least one (preferably two) extension 39 extending horizontally beyond (along the width of the base 30) and vertically below the slots 38. The two extensions 39 are positioned along opposite sides of the base 30 (corresponding to the two foot pedal supports 54). The extensions 39 also extend along at least a portion of the longitudinal length of the base 30. As shown in FIGS. 5-9, the extension 39 provide a flat surface for the wheels 56 of the foot pedal assembly 50 (as described further herein) to roll along (back and forth in the longitudinal direction) as the foot pedal assemblies 50 are moved. The top surface of the extensions 39 may optionally be padded for noise reduction.

Figure 8:
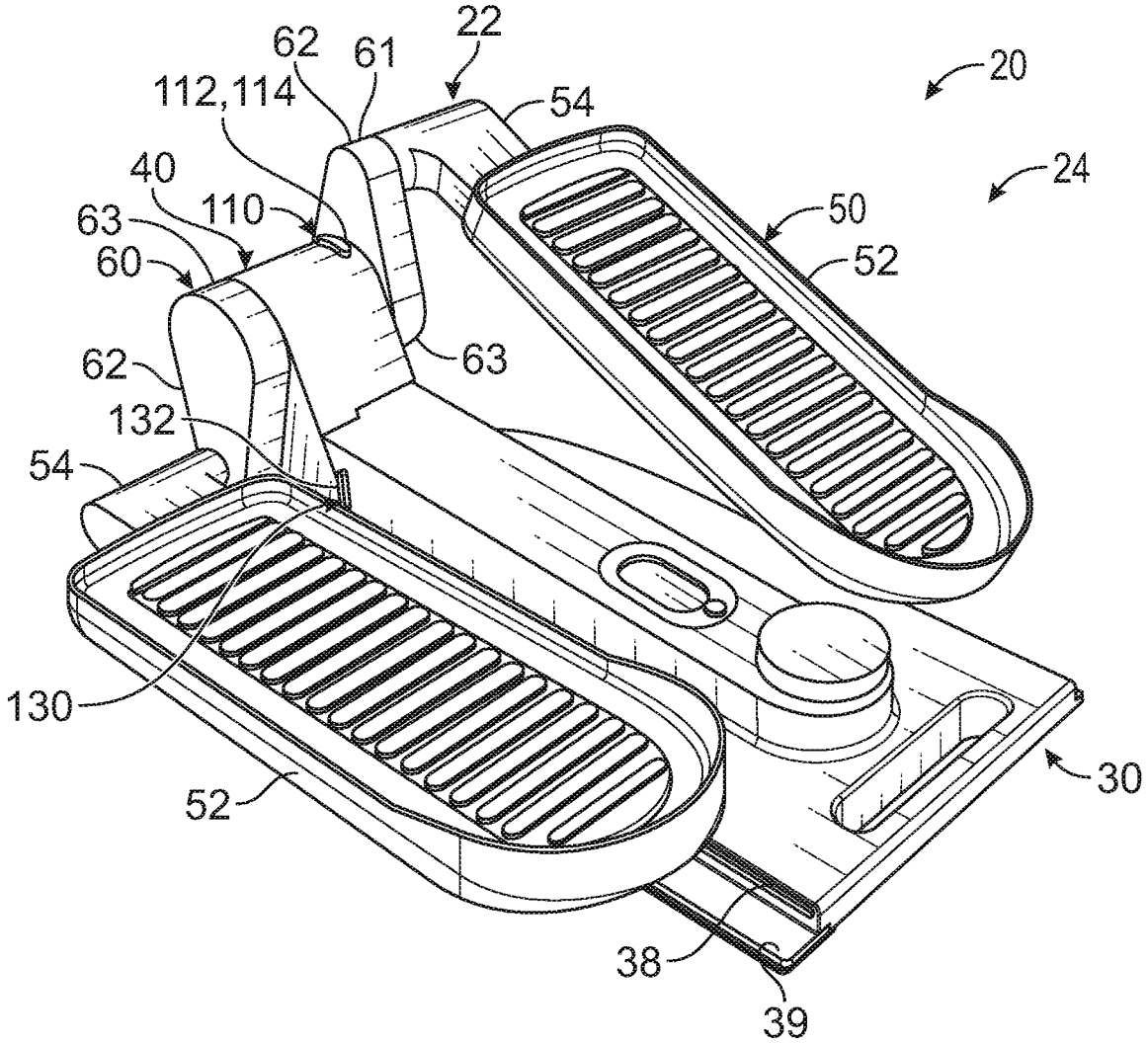
FIG. 8 is a front, perspective view of the exercise device of FIG. 1 in a use position.
Figure 9:
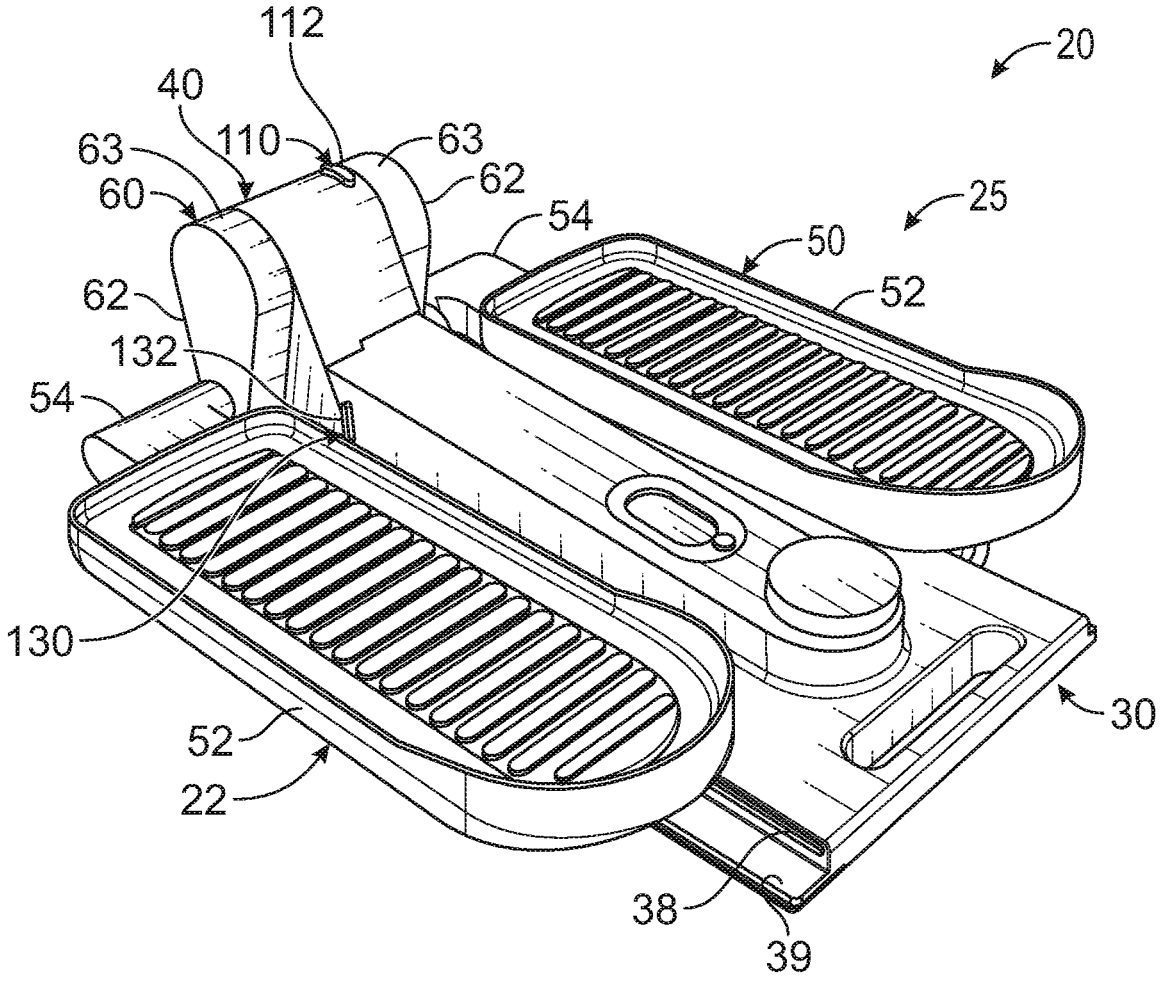
FIG. 9 is a front, perspective view of the exercise device of FIG. 1 in a compact position.
Figure 10:
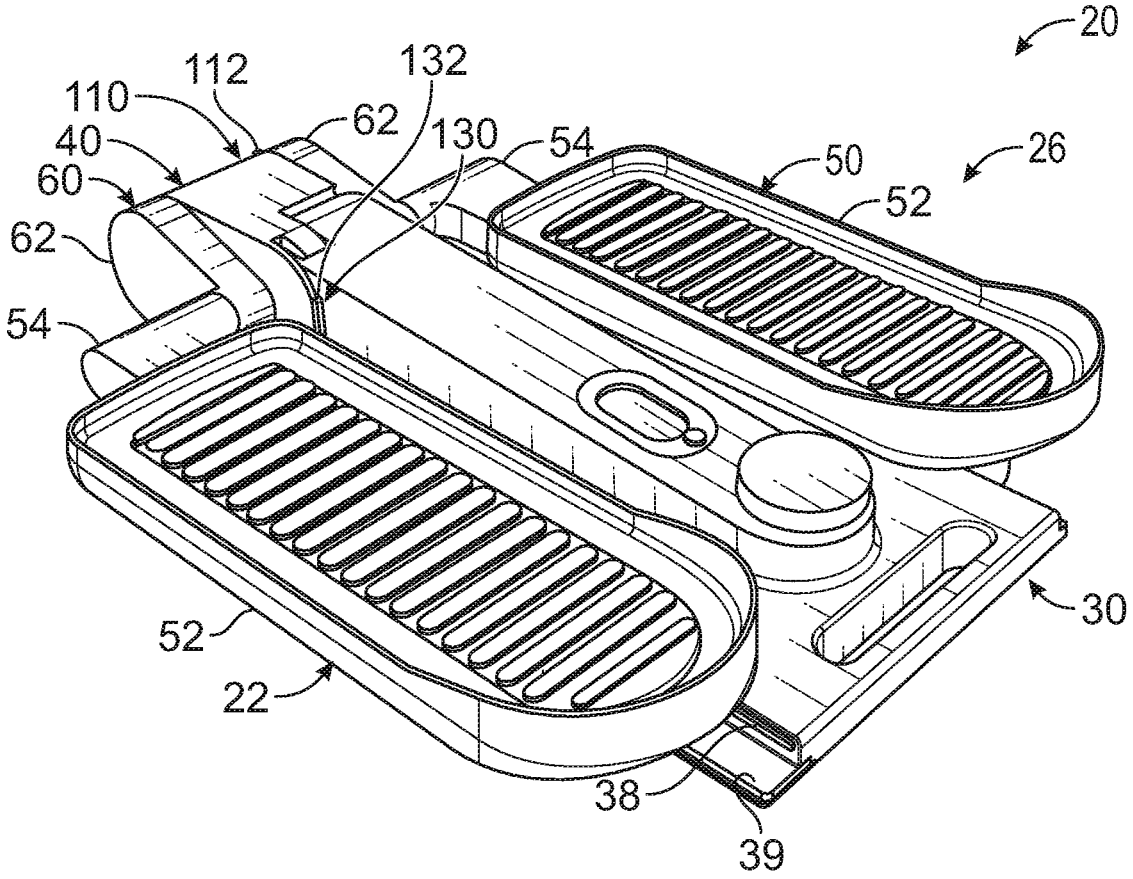
FIG. 10 is a front, perspective view of the exercise device of FIG. 1 in a folded position.

According to one embodiment, the crank support 40 is movably attached to a longitudinal end of the base 30 to allow the exercise device 20 to be moved from a use position 24 to a folded position 26 (as shown in FIGS. 8-10 and described further herein). (The exercise device 20 may also be moved to a compact position 25, as shown in FIG. 9 and described further herein.) The crankshaft 64 (as described further herein) is positioned at least partially within the crank support 40 (and is rotatable within and relative to the crank support 40). The crank support 40 is movable between the use position 24 and the folded position 26. The crank support 40 elevates the crankshaft 64 (as described further herein and illustrated in FIGS. 11-12) above the base 30 and above the countershaft 74 of the transfer assembly 70 in the use position 24, which elevates the cranks 62 and the second end portions 54*b* of the foot pedal supports 54 (and thus also the foot pedals 52). Compared to previous elliptical exercise devices, the height of the foot pedals 52 is reduced (from, for example, approximately 3 inches (in) to less than 3 inches, such as less than 2.5 inches, in one embodiment approximately 2.2 in), which allows the users to position their feet at a more natural foot height and is particularly advantageous for users who are tall and working at, for example, a desk while using the exercise device 20. The crank support 40 also lowers the crankshaft 64, the cranks 62, and the second end portions 54*b* of the foot pedal supports 54 (and thus also the foot pedals 52) in the folded position 26 to allow the entire exercise device 20 to have a slim profile for storage.

Figure 3:
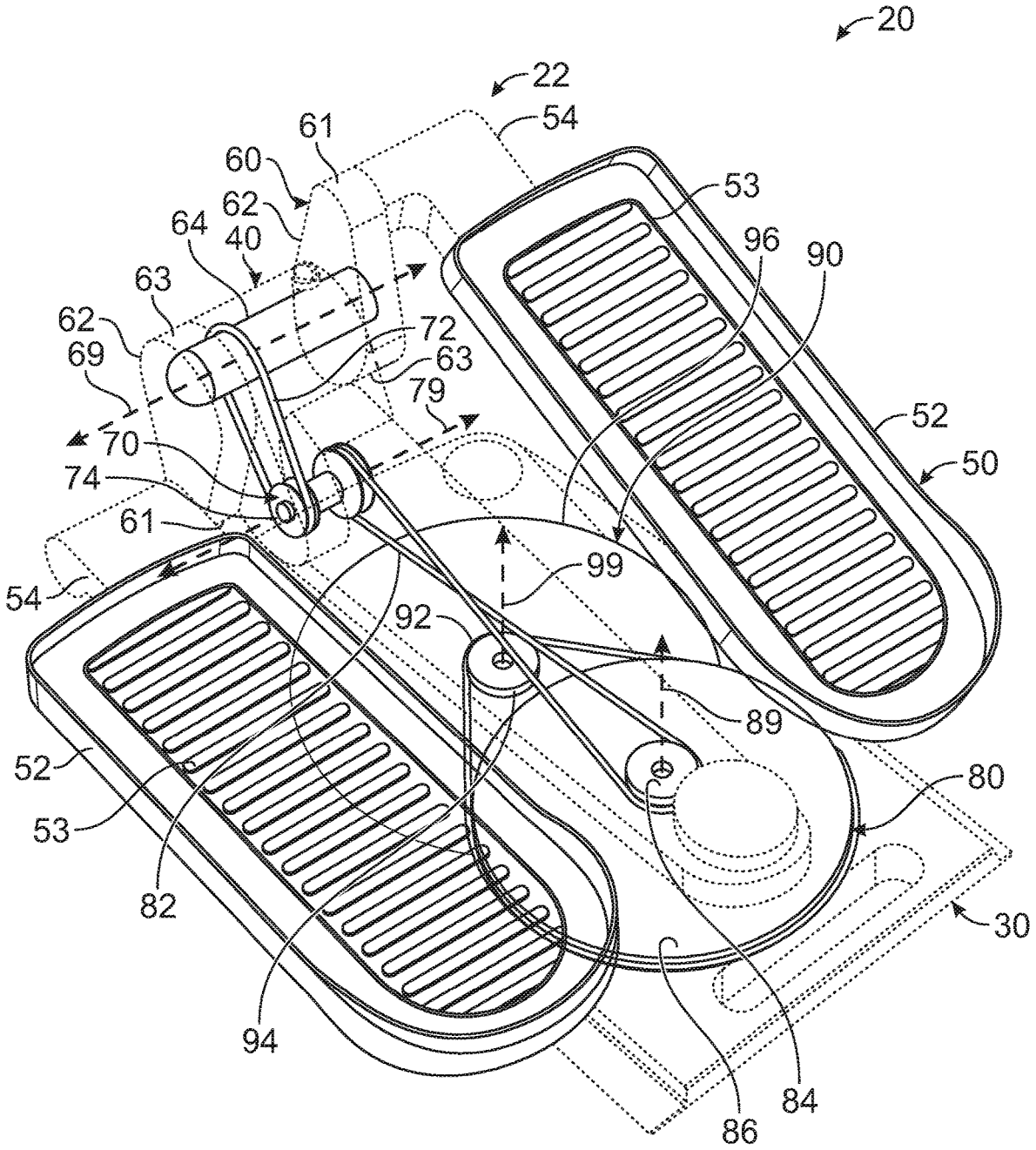
FIG. 3 is a partially-transparent, front perspective view of the exercise device of FIG. 1.
Figure 4:
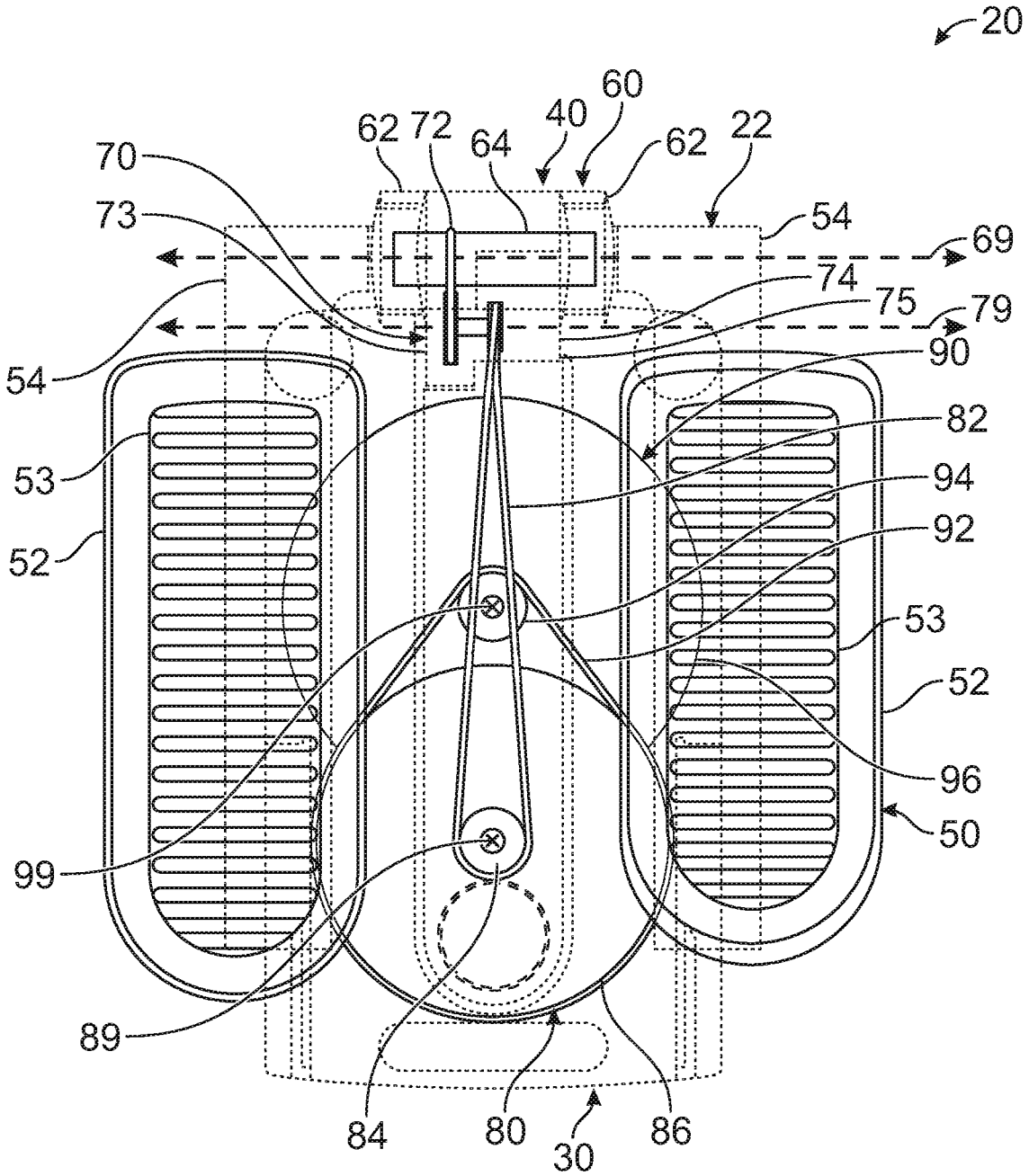
FIG. 4 is a partially-transparent, top view of the exercise device of FIG. 1.

As shown in FIGS. 3-4 in view of FIGS. 1-2, the base 30 and the crank support 40 each provide structural support to the exercise device 20 as well as cover and obscure most of the rotation assembly 22 (aside from the foot pedal assembly 50 and a portion of the crank assembly 60 (such as the cranks 62)), which minimizes the "visual mass" and simplifies the look of the exercise device 20. The base 30 and the crank support 40 each function as both a structural frame and a structural covering or shroud (such that the exercise device 20 does not include a separate frame or shroud). Since the exercise device 20 does not have a separate frame and shroud (such as a steel frame and a separate plastic shroud), the cost, number of parts, assembly time, and weight of the exercise device 20 is reduced. By reducing the weight, the exercise device 20 is easier to transport. Furthermore, with this configuration, the exercise device 20 can have tighter tolerances, resulting in a better quality device.

The rotation assembly 22 is a portion of the exercise device 20 that is movable relative to the base 30 and the crank support 40 as the user uses the exercise device 20 to exercise. As shown in FIGS. 3-4, the rotation assembly 22 includes an exercise interface assembly (which is referred to as a foot pedal assembly 50), a crank assembly 60, a transfer assembly 70, a pulley assembly 80, and a flywheel assembly 90.

As shown in FIGS. 1-4, the foot pedal assembly 50 includes at least one exercise interface (which is referred to as a foot pedal 52). Preferably, the foot pedal assembly 50 includes two foot pedals 52 that provide two areas for the user to put each their feet on to move the rotation assembly 22 and thus to exercise. Each of the foot pedals 52 are sized and shaped in order to receive at least a portion of one of the user's feet. The foot pedals 52 may each optionally include an outer rim that extends above a main top surface of the foot pedal 52 (along which the user positions their feet). The outer rim extends along at least a portion of the outer perimeter of the foot pedals 52 and is configured to prevent the user's foot from slipping off of the foot pedal 52 (along the length or width of the foot pedal 52) during use. The foot pedals 52 may each include a foot pad 53 positioned along the main top surface of the foot pedal 52. The foot pads 53 may include a textured surface to increase friction to the user's feet and prevent the user's feet from sliding off of the foot pedals 52. The foot pads 53 may also reduce any noise during use.

Figure 6:
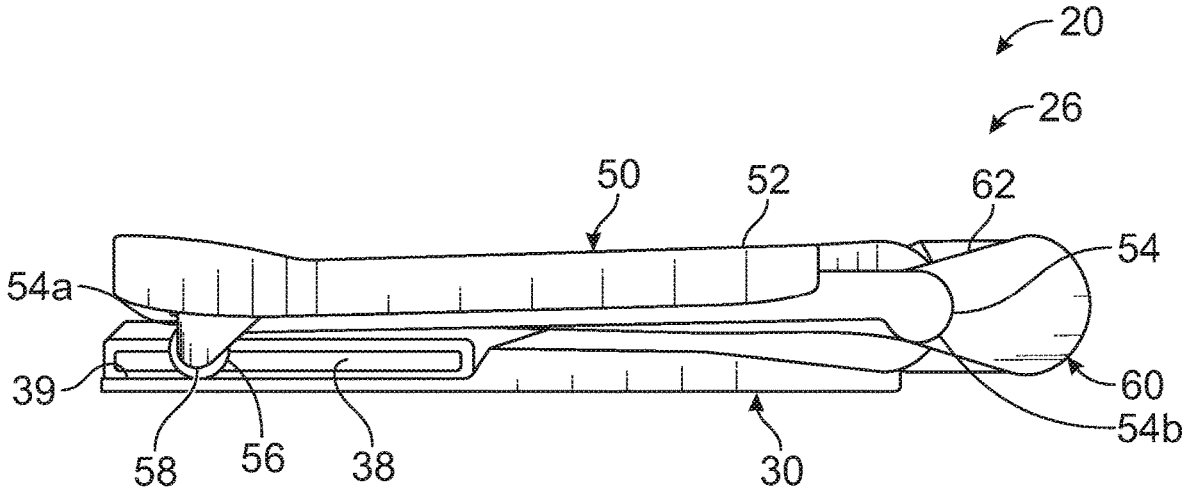
FIG. 6 is a side view of the exercise device of FIG. 1 in the folded position.

As shown in FIGS. 3-4, the foot pedal assembly 50 also includes at least one exercise support portion (which is referred to as a foot pedal support 54). Preferably, the foot pedal assembly 50 includes two foot pedal supports 54 that correspond to the two foot pedals 52 and rotatably connect each of the foot pedals 52 to the crank assembly 60 (in particular to the crank 62, as described further herein). The foot pedals 52 are each attached to one of the foot pedal supports 54 and are positioned such that the foot pedal supports 54 each extend at least partially underneath one of the foot pedals 52 for support. Accordingly, as shown in FIG. 6, a middle portion and optionally also a first end portion 54*a* of the foot pedal support 54 is positioned underneath the foot pedal 52, and a second end portion 54*b* of the foot pedal support 54 rotatably attaches to the crank 62 of the crank assembly 60 (where the first end portion 54*a* and the second end portion 54*b* are substantially opposite each other along the length of the foot pedal support 54), in particular to a first end 61 of the crank 62. Although the foot pedal assembly 50 with the foot pedals 52 and the foot pedal supports 54 for leg exercise is referred to herein, the exercise interface assembly may alternatively be a hand grip assembly with hand grips and hand grip supports for arm exercise.

Figure 5:
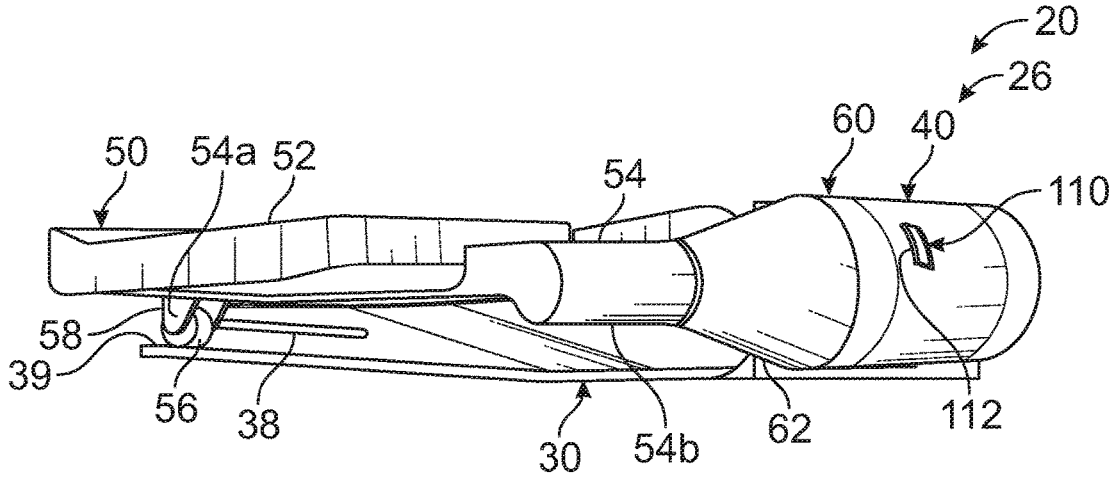
FIG. 5 is a back, perspective view of the exercise device of FIG. 1 in the folded position.
Figure 7:
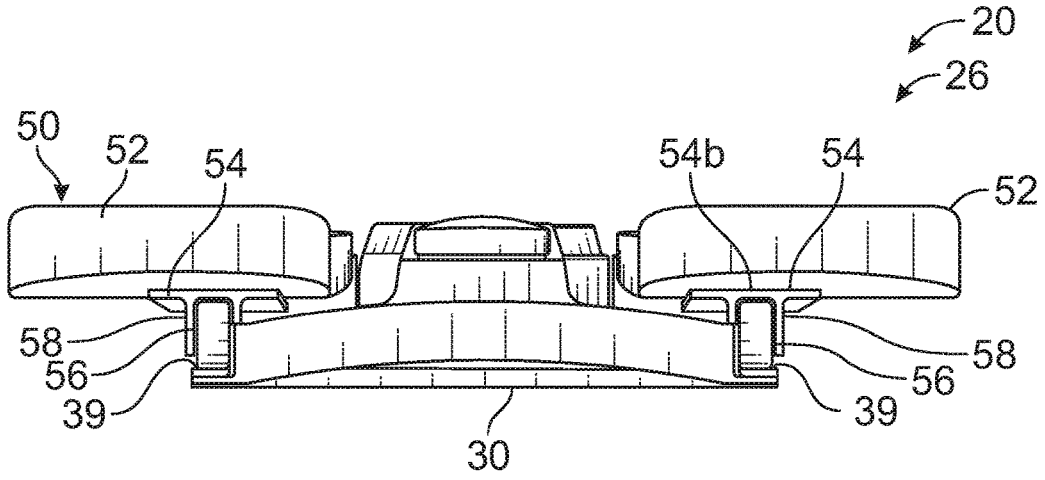
FIG. 7 is a front view of the exercise device of FIG. 1 in the folded position.

The first end portion 54*a* of the foot pedal support 54 is movable along at least a portion of the longitudinal length of the base 30, in particular along the top surface of the extension 39 of the base 30. According, as shown in FIGS. 5-7, each of the foot pedal supports 54 includes a wheel 56 and a wheel hub or support 58 that are positioned beneath the foot pedals 52 and along the first end portion 54*a* of the foot pedal support 54. The wheel support 58 is positioned along and statically connected to a bottom surface of the first end portion 54*a* of the foot pedal support 54 (directly beneath the foot pedal 52 and below an area that the end of the user's foot (such as the user's toes or heel) would be positioned during exercise use). The wheel support 58 is configured to rotatably attach the wheel 56 to the first end portion 54*a* of the foot pedal support 54. The wheel 56 is positioned between the foot pedal 52 and the extension 39 of the base 30 such that, as the foot pedal 52 moves (during exercise or as the exercise device 20 is moved between the use position 24 and the folded position 26, for example), the wheel 56 rolls along the top surface of the extension 39.

The first end portion 54*a* of the foot pedal support 54 (in particular the wheel support 58) comprises a pin or extension 57 that is configured to be received within, extend into, move within and be guided by the slot 38 of the base 30 during movement of the foot pedal 52 (see, for example, FIGS. 16 and 22-23), as described further herein. The extension 57 extends from an inner side portion of the wheel support 58 (in a direction toward the base 30). The extension 57 may optionally be an end portion of the axle of the wheel 56 (where the axle extends through and supports the wheel 56).

The crank assembly 60 is configured to allow the motion of the foot pedals 52 (due to the user's feet) to move the rest of the rotation assembly 22. As shown in FIGS. 3-4, the crank assembly 60 includes at least one (preferably two) crank arm or crank 62 and a crankshaft 64. The two cranks 62 correspond to and are rotatably attached to the two foot pedal supports 54. As shown in FIG. 3, a first end 61 of each of the cranks 62 rotatably attaches to the second end portion 54*b* of the foot pedal support 54. A second end 63 of each of the cranks 62 (that is substantially opposite the first end 61 along the length of the crank 62) is configured to be non-rotatably or statically fixable or attachable to one side of the crank support 40 through the crankshaft 64 (however, as described further herein, the crank 62 may be unlocked from the crankshaft 64 to rotate relative to the crankshaft 64 for folding). Accordingly, the cranks 62 are positioned along opposite ends of the crankshaft 64 and opposite sides of the crank support 40.

As shown in FIGS. 3-4, the driveshaft or crankshaft 64 is positioned at least partially within and rotatably attached to the crank support 40. Optionally, the crankshaft 64 may extend completely through the crank support 40 (and/or a portion of the second end 63 of the cranks 62 may extend partially into the crank support 40). Furthermore, the crankshaft 64 may optionally include bearings to allow the crankshaft 64 to rotate within the crank support 40. The crankshaft 64 extends axially along, defines, and rotates about a crank rotational axis 69, which, when the exercise device 20 is in use, extends substantially horizontally. Accordingly, the cranks 62 also rotate (with the crankshaft 64) about the crank rotational axis 69.

The second end 63 of each of the cranks 62 is statically attachable to an end of the crankshaft 64, such that the two cranks 62 are positioned along opposite ends of the crankshaft 64 and any motion of the cranks 62 (in particular rotational motion) causes the crankshaft 64 to move (or rotate) congruently (where both the cranks 62 and the crankshaft 64 rotate about the crank rotational axis 69). As shown in FIG. 3, the cranks 62 extend in opposite radial directions from each other at the two ends of the crankshaft 64. Accordingly, if the first end 61 of one of the cranks 62 is pointing upward, the first end 61 of the other crank 62 is pointing downward in the opposite direction. This configuration allows the two foot pedal supports 54 (and thus the two foot pedals 52) to be opposite each other along their respective rotational or elliptical paths while being moved, such that, for example, when one foot pedal 52 is up, the other foot pedal 52 is down. During normal use (i.e., in the use position 24), the foot pedals 52 rotate congruently with each other such that the foot pedals 52 are on opposite sides of the crankshaft rotational axis 69 defined by the crankshaft 64 during use. Since the second end portion 54*b* of the foot pedal support 54 is rotatably attached to the crank 62 which is attached to the crankshaft 64, the second end portion 54*b* of the foot pedal support 54 rotates about or moves around the crankshaft rotational axis 69, thereby providing an elliptical motion of the foot pedal support 54 (and the foot pedal 52). In particular, since the foot pedal support 54 is rotatable relative to the crank 62 and the first end portion 54*a* of the foot pedal support 54 is guided (optionally linearly) by the base 30, the foot pedal support 54 (and thus the foot pedal 52) is configured to move in an elliptical manner relative to the base 30. However, the foot pedal support 54 and the foot pedal 52 may be configured to move in other rotational manners, such a circular manner, depending on the desired configuration.

Figure 22:
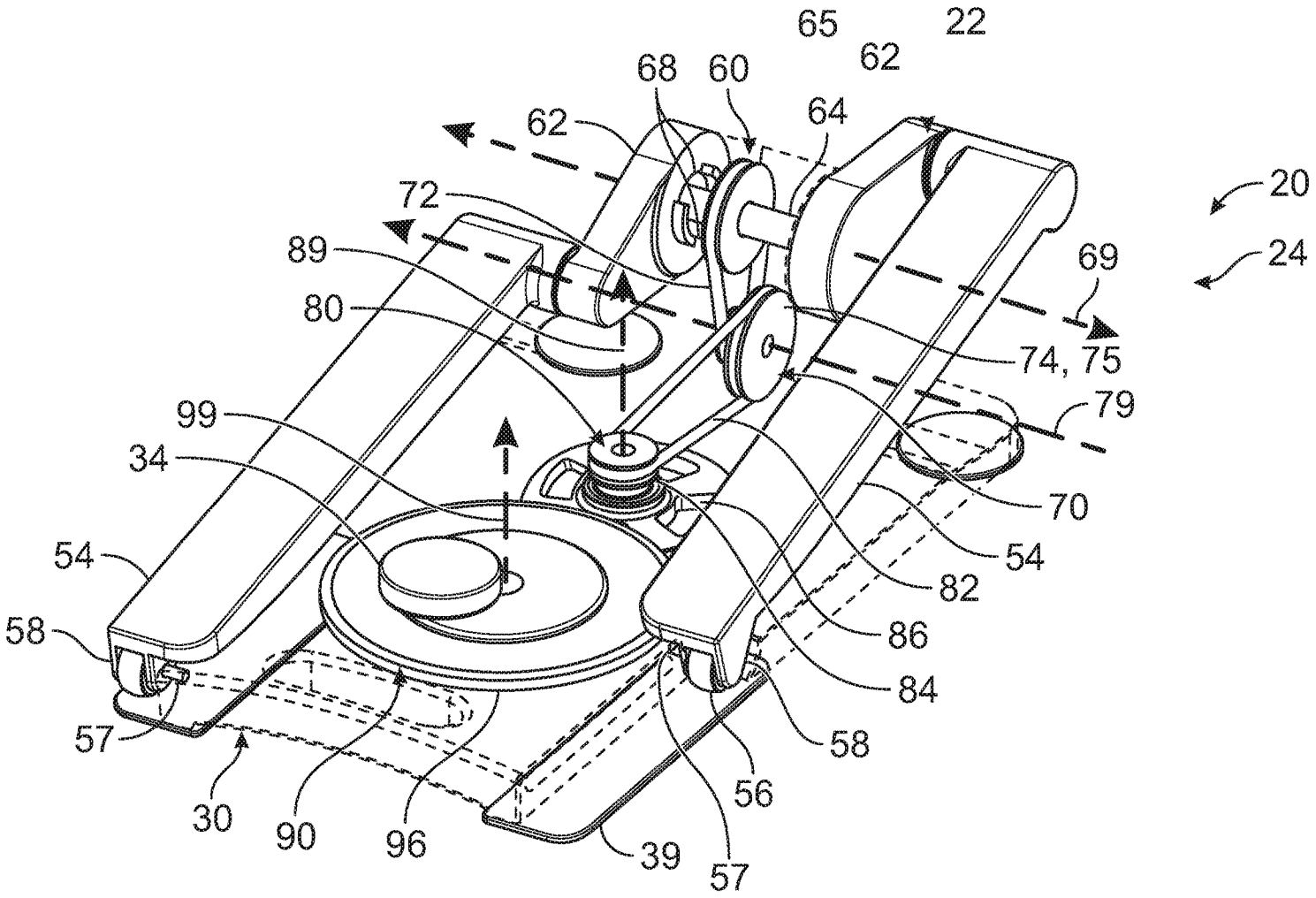
FIG. 22 is a top perspective view of an exercise device according to another embodiment (with certain components not shown for clarity).
Figure 23:
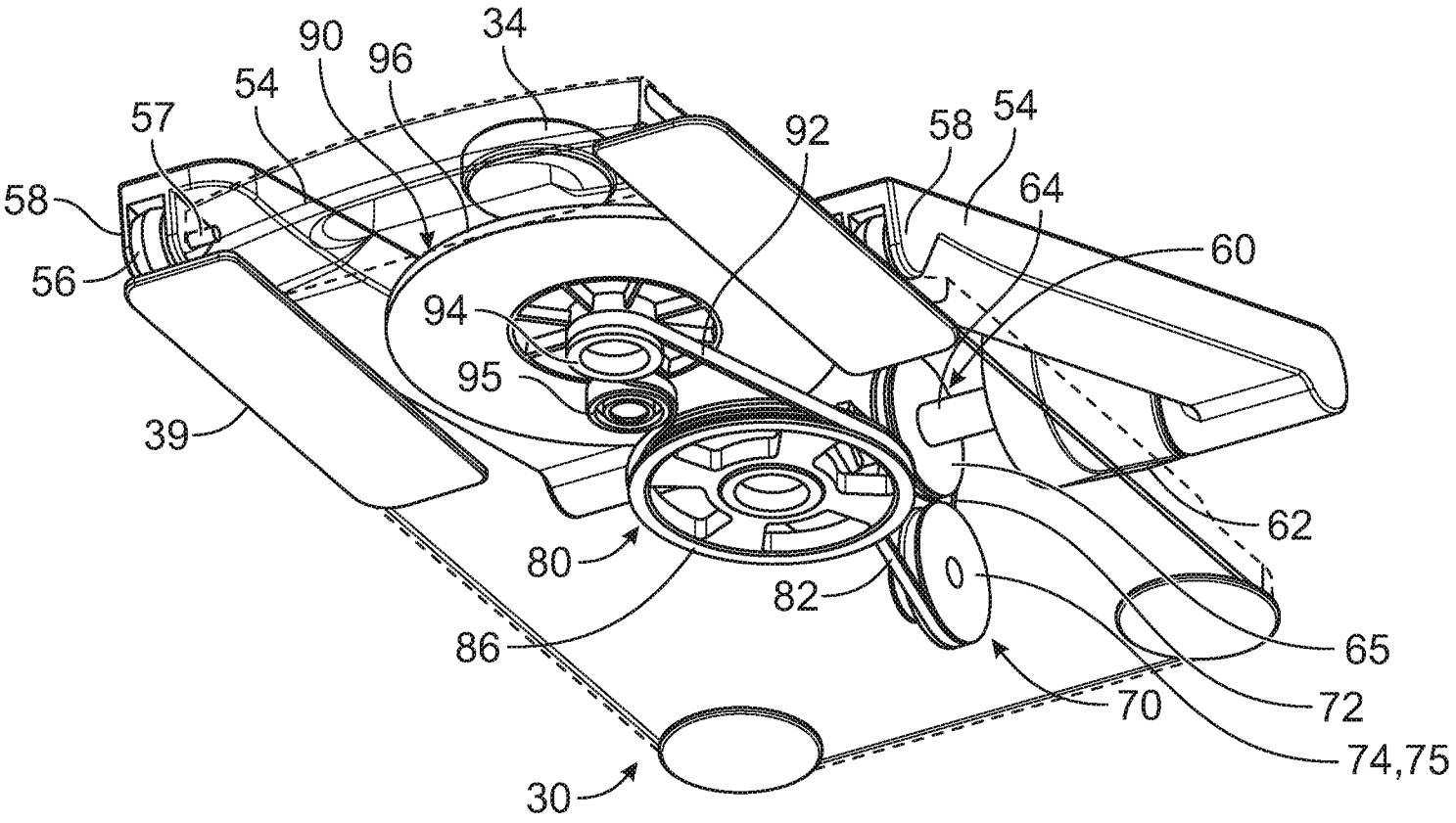
FIG. 23 is a bottom perspective view of the exercise device of FIG. 22.
Figure 24:
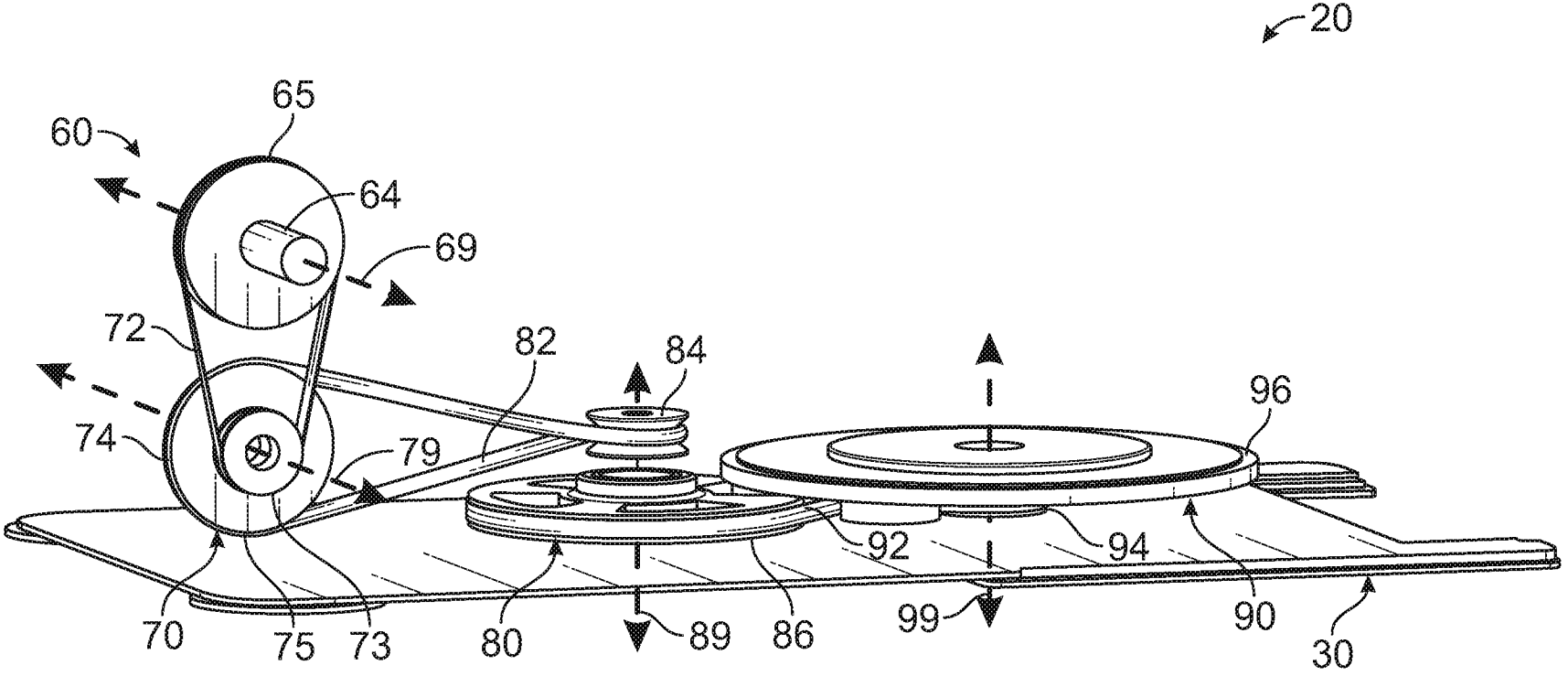
FIG. 24 is a side perspective view of the exercise device of FIG. 22 with additional components not shown for clarity.

According to one embodiment as shown in FIGS. 22-24, the crankshaft 64 includes a crankshaft wheel or pulley 65 positioned along a middle portion of the crankshaft 64. The crankshaft pulley 65 has a larger outer diameter than the rest of the crankshaft 64 and moves or rotates congruently with the rest of the crankshaft 64 (about the crankshaft rotational axis 69). The transfer belt 72 is positioned along a portion of the outer circumference of the crankshaft pulley 65.

The transfer assembly 70 is configured to translate or transmit motion of the crank assembly 60 (in particular of the crankshaft 64 and the cranks 62) to the pulley assembly 80 (in particular to the pulley 86), and thus to the flywheel 96 of the flywheel assembly 90 (as described further herein). As shown in FIGS. 3-4, the transfer assembly 70 includes a transfer cord or belt 72 that is a continuous band of material and loops and extends around a portion of the crankshaft 64 (such as a main or middle body portion of the crankshaft 64 that is positioned between the two ends of the crankshaft 64 that are attached to the cranks 62) and around a portion (such as the first end 73) of the countershaft 74. Accordingly, the crankshaft 64 and the countershaft 74 are positioned within a loop formed by the transfer belt 72 and abut the inner surface of the transfer belt 72. The transfer belt 72 transfers rotation of the crankshaft 64 to rotation of the countershaft 74. As the crankshaft 64 is rotated, the transfer belt 72 is moved congruently with the crankshaft 64 such that the transfer belt 72 is conveyed with and around the crankshaft 64, thereby rotating the transfer belt 72 around the crankshaft 64. In order to attach with the crankshaft 64, the transfer belt 72 is positioned at least partially within the crank support 40 (and optionally may extend partially into the base 30).

The transfer assembly 70 further includes a countershaft 74 (which may also be referred to as a jackshaft, a transfer shaft, or a driveshaft) that is rotated by the transfer belt 72 (as the transfer belt 72 is moved due to the crankshaft 64). The countershaft 74 may be at least partially positioned within the base 30 and/or the crank support 40. For example, a first end 73 of the countershaft 74 may extend within the crank support 40 (and outside of the base 30), and a second end 75 of the countershaft 74 may extend within the base 30 (and outside of the crank support 40).

As shown in FIGS. 3-4, the countershaft 74 extends axially along, rotates about, and defines a transfer rotational axis 79 (which may be referred to as the countershaft rotational axis 79), which, when the exercise device 20 is in use, extends substantially horizontally. Accordingly, the countershaft rotational axis 79 is substantially parallel to the crankshaft rotational axis 69. In the use position, the countershaft rotational axis 79 is vertically lower than the crankshaft rotational axis 69. According to one embodiment as shown in FIG. 3, the countershaft rotational axis 79 and the crank rotational axis 69 are parallel, but separate and spaced apart from each other. However, according to various other embodiments as described further herein (as shown, for example, in FIGS. 28-29), the countershaft rotational axis 79 and the crank rotational axis 69 are parallel and are (or extend along) the same axis.

As shown in FIG. 4, the countershaft 74 extends between and includes the first portion or end 73 and the second portion or end 75 (that rotate congruently with each other about the countershaft rotational axis 79). One end (such as the first end 73) of the countershaft 74 may have a smaller diameter than the other end (such as the second end 75) of the countershaft 74 (as also shown in FIG. 24). The transfer belt 72 extends around a portion (such as the first end 73) of the countershaft 74, and the pulley belt 82 (as described further herein) extends around another portion (such as the second end 75) of the countershaft 74. As the transfer belt 72 is conveyed, the countershaft 74 rotates congruently about the countershaft rotational axis 79 (which moves the pulley belt 82 congruently).

According to one embodiment as shown in FIG. 24, the countershaft 74 may be a double pulley (with two pulleys on opposite ends) or a wheel and a hub that extends beyond one side of the wheel (where the wheel and the hub are positioned along opposite ends of the countershaft 74). For example, the first end 73 may be a countershaft hub or pulley, and the second end 75 may be a countershaft wheel or pulley (or vice versa). The two pulleys of the double pulley or the wheel and the hub rotate congruently. In these configurations, the transfer belt 72 extends around one of the pulleys or the hub and the pulley belt 82 extends around the other pulley or the wheel.

The pulley assembly 80 is configured to translate or transmit motion of the transfer assembly 70 (in particular of the countershaft 74) to the flywheel assembly 90 (in particular to the flywheel 96). The pulley assembly 80 is positioned within the base 30. As shown in FIGS. 3-4, the pulley assembly 80 includes a pulley cord or belt 82, a pulley hub 84 (which may be a secondary pulley), and a wheel or pulley 86. The pulley hub 84 and the pulley 86 extend axially along, define, and rotate about a pulley rotational axis 89, which, when the exercise device 20 is in use, extends substantially vertically, and thus substantially perpendicular to the crank rotational axis 69 and the countershaft rotational axis 79.

The pulley belt 82 is a continuous band of material and loops and extends around an outer circumferential portion (such as the second end 75) of the countershaft 74 and around the outer circumference of the pulley hub 84 such that the countershaft 74 and the pulley hub 84 are positioned within a loop formed by the pulley belt 82 and abut the inner surface of the pulley belt 82. The pulley belt 82 transfers rotational movement of a portion of the transfer assembly 70 (in particular the countershaft 74) about the countershaft rotational axis 79 to rotational movement of a portion of the pulley assembly 80 (in particular the pulley hub 84 and thus also the pulley 86) about the pulley rotational axis 89. Accordingly, the pulley belt 82 is part of a sequence of parts that translates rotational movement from the crank assembly 60 about the crank rotational axis 69 to rotational movement of the flywheel 96 about the flywheel rotational axis 99.

As the countershaft 74 is rotated, the pulley belt 82 is moved congruently with the countershaft 74 such that the pulley belt 82 is conveyed with and around the countershaft 74, thereby rotating the pulley belt 82 around the countershaft 74. In order to attach to and extend around both the countershaft 74 (which rotates about the substantially horizontal countershaft rotational axis 79 extending through its center) and the pulley hub 84 (which rotates about the substantially vertical pulley rotational axis 89 extending through its center), the pulley belt 82 is twisted approximately 90° along its length as it extends between the countershaft 74 and the pulley hub 84, thereby translating rotational movement about a substantially horizontal axis (i.e., about the countershaft rotational axis 79) to rotational movement about a substantially vertical axis (i.e., about the pulley rotational axis 89).

The pulley hub 84 and the pulley 86 share the same pulley rotational axis 89 that extends substantially vertically. The pulley hub 84 is positioned at the center of the pulley 86 (that defines the substantially vertical pulley rotational axis 89 of the pulley hub 84 and the pulley 86) and extends beyond one side of the pulley 86 in order to provide an area for the pulley belt 82 to extend around and attach to. The pulley hub 84 and the pulley 86 are statically fixed together such that rotation of the pulley hub 84 causes the pulley 86 to rotate congruently about the pulley rotational axis 89. The pulley hub 84 has a significantly smaller dimeter than the pulley 86.

The pulley 86 is relatively large (along its diameter), flat, and thin (along its thickness or height) and extends radially in the horizontal direction (when the exercise device 20 is in use). By having a large diameter, the pulley 86 can rotate the flywheel 96 faster (e.g., 10× as fast as the crank 62). By rotating the flywheel 96 faster, the exercise device 20 has a smoother feel. The diameter of the pulley 86 may be smaller than the flywheel 96. The pulley 86 is vertically aligned with the flywheel hub 94 to allow the flywheel belt 92 to be smoothly transferred between the pulley 86 and the flywheel hub 94.

The flywheel assembly 90 is configured to increase the momentum within the exercise device 20 to thereby provide greater stability to the exercise device 20 during use. The flywheel assembly 90 is also positioned within the base 30. As shown in FIGS. 3-4, the flywheel assembly 90 includes a flywheel cord or belt 92, a flywheel hub 94 (which may be a secondary flywheel pulley), and a flywheel 96. The flywheel hub 94 and the flywheel 96 extend axially along, define, and rotate about a flywheel rotational axis 99, which, when the exercise device 20 is in use, extends substantially vertically and thus substantially parallel to the pulley rotational axis 89 and substantially perpendicular to the crank rotational axis 69 and the countershaft rotational axis 79.

The flywheel belt 92 is a continuous band of material that extends around the outer circumference of the pulley 86 and around the outer circumference of the flywheel hub 94 such that the flywheel hub 94 and the pulley 86 are positioned within the flywheel belt 92 and abut the inner surface of the flywheel belt 92. The flywheel belt 92 transfers rotation of the pulley 86 to rotation of the flywheel hub 94 (and thus also the flywheel 96). As the pulley 86 is rotated, the flywheel belt 92 is moved congruently with the pulley 86 such that the flywheel belt 92 is conveyed with and around the pulley 86, thereby rotating the flywheel belt 92 around the pulley 86.

The flywheel hub 94 and the flywheel 96 are positioned within the base 30 and share the same flywheel rotational axis 99 that extends substantially vertically. The flywheel hub 94 is positioned at the center of the flywheel 96 (that defines the substantially vertical flywheel rotational axis 99 of the flywheel hub 94 and the flywheel 96) and extends beyond one side of the flywheel 96 in order to provide an area for the flywheel belt 92 to extend around and attach to. The flywheel hub 94 and the flywheel 96 are statically fixed together such that rotation of the flywheel hub 94 causes the flywheel 96 to rotate congruently about the flywheel rotational axis 99. The flywheel hub 94 has a significantly smaller dimeter than the flywheel 96. The flywheel 96 and the flywheel hub 94 rotate about and define the substantially vertical flywheel rotational axis 99 that is substantially parallel to the substantially vertical pulley rotational axis 89 defined by the pulley 86 and pulley hub 84 (and substantially perpendicular to the crank rotational axis 69 and the countershaft rotational axis 79).

The flywheel 96 is relatively large (along its diameter), flat, and thin (along its thickness or height) and extends radially in the horizontal direction (when the exercise device 20 is in use). This configuration of the flywheel 96 allows the exercise device 20 to have a relatively low-profile (and for the entire base 30 to be relatively low-profile). For example, according to one embodiment, the flywheel 96 has a diameter of approximately 9.5 in and a thickness of approximately 0.25 in.

Optionally, as shown in FIG. 23, the flywheel assembly 90 may include a guide 95 that is positioned next to (and along the same side of the flywheel 96 as) the flywheel hub 94. The guide 95 may guide the movement and control the tension of the flywheel belt 92. The guide 95 is positioned along the outside of the flywheel belt 92 and thereby abuts the outer surface of the flywheel belt 92. Comparatively, the flywheel hub 94 and the pulley 86 are positioned within the flywheel belt 92 and abut the inner surface of the flywheel belt 92.

By positioning the flywheel 96 (as well as the pulley 86) along a bottom region of the base 30 (and, when the exercise device 20 is in use, extending radially and tangentially substantially horizontally (parallel to the ground) with respective substantially vertical flywheel and pulley rotational axes 99 and 89), the exercise device 20 has a relatively low profile and low center of gravity (literally and visually), which increases the stability of the exercise device 20 and allows the exercise device 20 to be more compact for portability. Furthermore, with this configuration, the exercise device 20 has a more compact arrangement. In addition, the flywheel 96 and the pulley 86 may also at least partially vertically overlap each other for a further compact arrangement.

According to one embodiment as shown in FIGS. 3-4, the pulley hub 84 and the pulley 86 are positioned along an opposite end of the exercise device 20 from the countershaft 74 and the crankshaft 64. Accordingly, at least a portion of the flywheel hub 94 and the flywheel 96 are positioned between the pulley hub 84 and the pulley 86 and the countershaft 74 and the crankshaft 64 along the longitudinal length of the base 30. The pulley belt 82 extends over at least a portion of the flywheel hub 94 and the flywheel 96 to reach the pulley hub 84.

Furthermore, the pulley 86 is positioned above the flywheel 96. Accordingly, the pulley hub 84 is positioned above the pulley 86 (to connect with the pulley belt 82), and the flywheel hub 94 is positioned above the flywheel 96 (to connect with the flywheel belt 92). The flywheel hub 94 is vertically aligned with the pulley 86 to allow the flywheel belt 92 to extend around both the flywheel hub 94 and the pulley 86.

According to another embodiment as shown in FIGS. 22-24, the flywheel hub 94 and the flywheel 96 are instead positioned along an opposite end of the exercise device 20 as the countershaft 74 and the crankshaft 64. Accordingly, at least a portion of the pulley hub 84 and the pulley 86 are positioned between the flywheel hub 94 and the flywheel 96 and the countershaft 74 and the crankshaft 64 along the longitudinal length of the base 30. The pulley belt 82 therefore does not extend over the flywheel hub 94 and the flywheel 96.

Furthermore, the flywheel 96 is positioned above the pulley 86. Accordingly, the pulley hub 84 is positioned above the pulley 86 (to connect with the pulley belt 82), and the flywheel hub 94 is positioned below the flywheel 96 (to connect with the flywheel belt 92). The flywheel hub 94 is vertically aligned with the pulley 86 to allow the flywheel belt 92 to extend around both the flywheel hub 94 and the pulley 86.

To increase how easily the exercise device 20 is transported (in particular carried), the exercise device 20 can partially or completely fold flat by moving from the use position 24 (in which the exercise device 20 is ready to be used by the user for elliptical exercise as shown in FIG. 8) to a compact position 25 (as shown in FIG. 9) and optionally to the flat or folded position 26 (as shown in FIG. 10). By folding partially or fully flat, the exercise device 20 is more compact, and the user can easily carry and move the exercise device 20 to different locations (e.g., from room to room or to and from work) and store the exercise device 20. Furthermore, by folding flat and being so compact, the exercise device 20 may be shipped fully assembled, which is rare with fitness equipment. According to one embodiment, the exercise device 20 may fold such that the overall height of the exercise device 20 is reduced to approximately 3.3 in.

FIGS. 8-14 show how the exercise device 20 is folded flat by moving from the use position 24, to the compact position 25, and then to the folded position 26. Accordingly, the exercise device 20 includes a first locking mechanism 110 and a second locking mechanism 130. The first locking mechanism 110 is configured to lock one of the cranks 62 into a desired position (i.e., into the use position 24 or the compact position 25). The second locking mechanism 130 is configured to lock the crank support 40 into the desired position (i.e., into the use position 24 or the folded position 26).

FIGS. 8-10 show an overview of how the exercise device 20 is moved between the use position 24, the compact position 25, and the folded position 26. First, to move from the use position 24 (as shown in FIG. 8) to the compact position 25 (as shown in FIG. 9), one of the foot pedals 52 (which is locked to the crankshaft 64 via its respective crank 62) is moved to its lowest position about the horizontal crankshaft rotational axis 69, and the other foot pedal 52 (which is connected to a crank 62 that is configured to be lockable to and unlockable from the crankshaft 64) is accordingly moved to its highest position about the horizontal crankshaft rotational axis 69. By unlocking the crank 62, the crank 62 can be rotated relative to the crankshaft 64. In particular, the user activates the first locking mechanism 110 (as described further herein) by activating (e.g., sliding, pushing, or pressing) a first control 112 of the first locking mechanism 110, which allows the higher of the two foot pedals 52 (and the corresponding foot pedal support 54 and crank 62) to rotate downwardly about the horizontal crankshaft rotational axis 69 to its lowest position relative to the crank support 40 and the crankshaft 64, while the other foot pedal 52 (and its corresponding foot pedal support 54 and crank 62), which is already in its lowest position, does not move and maintains its position about the horizontal crankshaft rotational axis 69, as shown in FIG. 9. When both of the cranks 62 are in their lowest positions about the crankshaft rotational axis 69, aligned with each other, and pointing in the same direction, the exercise device 20 is in the compact position 25 (although the crank support 40 may still optionally be in a use position).

Subsequently, to move from the compact position 25 (as shown in FIG. 9) to the folded position 26 (as shown in FIG. 10), the user activates the second locking mechanism 130 by activating (e.g., sliding, pushing, or pressing) a second control 132 of the second locking mechanism 130, which allows the crank support 40 to rotate downwardly about the horizontal countershaft rotational axis 79 (see FIGS. 3-4), until the crank support 40 is substantially horizontal and the top of the crank support 40 is approximately parallel to and vertically aligned with the top of the base 30, as shown in FIG. 10. These steps are reversed in order to move the exercise device 20 from the folded position 26, to the compact position 25, and to the use position 24.

As shown in FIGS. 8-10, the first control 112 is positioned along a top surface of the crank support 40, and the second control 132 is positioned along a side surface of an elevated middle portion (that is positioned between the two foot pedals 52 and foot pedal supports 54) of the base 30. However, according to various other embodiments, the first control 112 and the second control 132 may be positioned along other areas of the exercise device 20. According to one embodiment, the first control 112 and the second control 132 are both levers. However, according to various other embodiments, the first control 112 and the second control 132 may be other controls, such as buttons, tabs, or switches.

Figure 11:
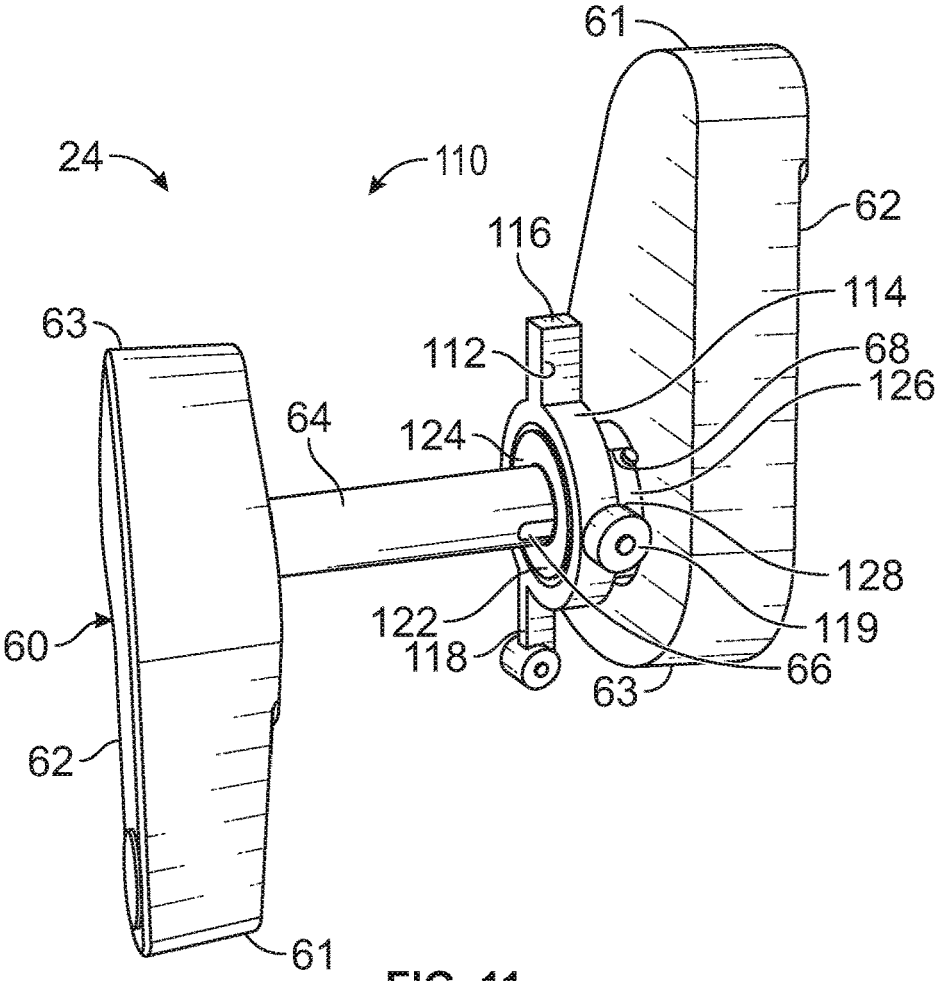
FIG. 11 is a perspective view of a first locking mechanism of the exercise device of FIG. 1 in the use position.
Figure 12:
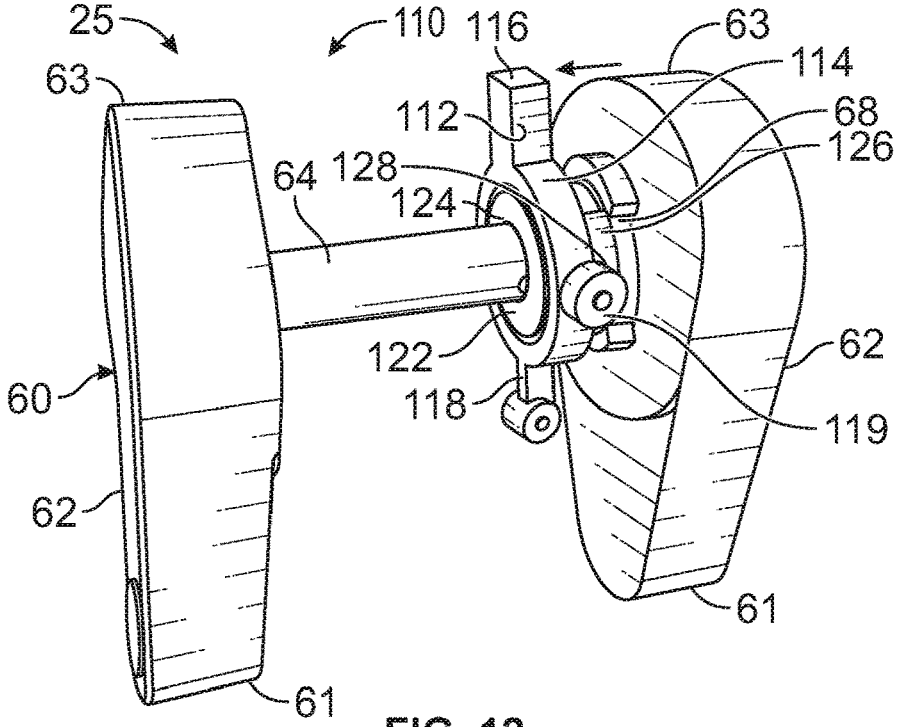
FIG. 12 is a perspective view of the first locking mechanism of the exercise device of FIG. 1 in the folded position.

FIGS. 11-14 show a detailed view of the mechanisms of the first locking mechanism 110 and the second locking mechanism 130, respectively. In particular, as shown in FIGS. 11-12, the first locking mechanism 110 includes the first control 112 and a slidable lock 122 that each define an aperture through which the crankshaft 64 extends (such that the first control 112 and the slidable lock 122 are each positioned circumferentially around the crankshaft 64 along the length of the crankshaft 64). The first control 112 and the slidable lock 122 are positioned along one end of the crankshaft 64 in order to interact with (i.e., lock and unlock) one of the cranks 62 (i.e., the lockable crank 62) relative to the crankshaft 64. The other crank 62 (i.e., the fixed crank 62) is fixed to (optionally permanently fixed to) the crankshaft 64 along the other end of the crankshaft 64. Alternatively, the other crank 62 may also include the first locking mechanism 110 to be unlockable from the crankshaft 64.

The first control 112 includes a ring 114 that defines the aperture through which the crankshaft 64 extends (and the slidable lock 122 may also be at least partially positioned within the aperture of the first control 112). The first control 112 also includes a control extension 116, a pivot extension 118, and an interlocking extension 119, all of which extend radially outward from an outer circumferential surface of the ring 114. The control extension 116 is configured to extend upward from the ring 114 and through an outer shell of the crank support 40 (as shown in FIG. 8) in order to provide an area for the user to directly interact with (to activate the first locking mechanism 110). The pivot extension 118 extends from an opposite radial side of the ring 114 as the control extension 116 and is configured to pivotably attach the first control 112 to another component (such as an inner portion of the crank support 40). The interlocking extension 119 is positioned between the control extension 116 and the pivot extension 118 about the outer circumference of the ring 114 and is configured to interlock with a notch of the slidable lock 122 (as described further herein). The first control 112 may be biased or spring loaded to automatically pivot about the pivot extension 118 toward the lockable crank 62. Accordingly, the first control 112 may be a leaf spring or may include a spring (such as a compression spring) or rubber pad to bias the first control 112 toward the slidable lock 122 and the lockable crank 62.

The slidable lock 122 is positioned axially next to the first control 112 along the axial length of the crankshaft 64 and closer to the end of the crankshaft 64 in order to directly interact with one of the cranks 62. The slidable lock 122 also includes a ring 124 that defines the aperture through which the crankshaft 64 extends. The slidable lock 122 includes inner rails or protrusions that extend radially inwardly from the inner circumferential surface of the ring 124 and are configured to be received by and slide along slots 66 defined by the crankshaft 64 (as shown in FIG. 17). These inner protrusions prevent the slidable lock 122 from rotating about the crankshaft 64 (i.e., the slidable lock 122 is rotationally fixed to the crankshaft 64). The slidable lock 122 also includes an extension 126 that extends radially outward from an outer circumferential surface of the ring 124 and is configured to lock with a portion (i.e., a crank groove 68) of the crank 62. Accordingly, the crank 62 defines the crank groove 68 that is configured to interlock with and receive the extension 126, thereby allowing or preventing relative rotational movement between the crank 62 and the extension 126 (and thus also the slidable lock 122 and the crankshaft 64, which are rotationally fixed together). The extension 126 also defines a groove or notch 128 that is configured to receive and interlock with the interlocking extension 119 of the first control 112. According to one embodiment, the first control 112 may have two interlocking extensions 119 (extending from opposite sides of the ring 114), and the slidable lock 122 includes two extensions 126 (extending from opposite sides of the ring 124) that each have a notch 128 such that the first control 112 and the slidable lock 122 interlock with each other in two areas on opposite sides of the crankshaft 64. As shown in FIG. 22, the crank 62 also includes two crank grooves 68 on opposite sides to interlock with the two extensions 126.

In FIG. 11, the exercise device 20 (in particular the crank assembly 60) is in the use position 24. Accordingly, the first locking mechanism 110 is locking one of the cranks 62 (i.e., the lockable crank 62) into a positon along the crankshaft 64 in which the crank 62 extends in an opposite direction from the other crank 62 (i.e, the fixed crank 62). In this position, the first control 112 is pivoted about the end of the pivot extension 118 toward the lockable crank 62 and thus toward the slidable lock 122, thereby interlocking the interlocking extension 119 into the notch 128 of the extension 126 of the slidable lock 122, which presses the extension 126 of the slidable lock 122 into the crank groove 68 of the lockable crank 62 and rigidly rotationally fixes the lockable crank 62 to the crankshaft 64 (since the slidable lock 122 cannot rotate about the crankshaft 64).

By pushing the control extension 116 of the first control 112 (in the direction of the arrow shown in FIG. 12) away from the lockable crank 62, the first control 112 rotates about a pivot axis along the pivot extension 118 in a direction away from the lockable crank 62. This movement allows the extension 126 of the slidable lock 122 to also move away and disengage from the crank groove 68 of the crankshaft 64 (along the slots 66 of the crankshaft 64), thereby allowing the lockable crank 62 to move and rotate relative to the slidable lock 122 and the crankshaft 64. The user can then rotate the lockable crank 62 (and its corresponding foot pedal 52) downward about the crankshaft 64 to extend in the same direction (or be in the same orientation) as the opposite crank 62 (as shown in FIG. 9) and into the compact position 25. The lockable crank 62 may include inner ball bearings to allow the lockable crank 62 to rotate freely about the crankshaft 64 when the slidable lock 122 is disengaged from the lockable crank 62.

Figure 13:
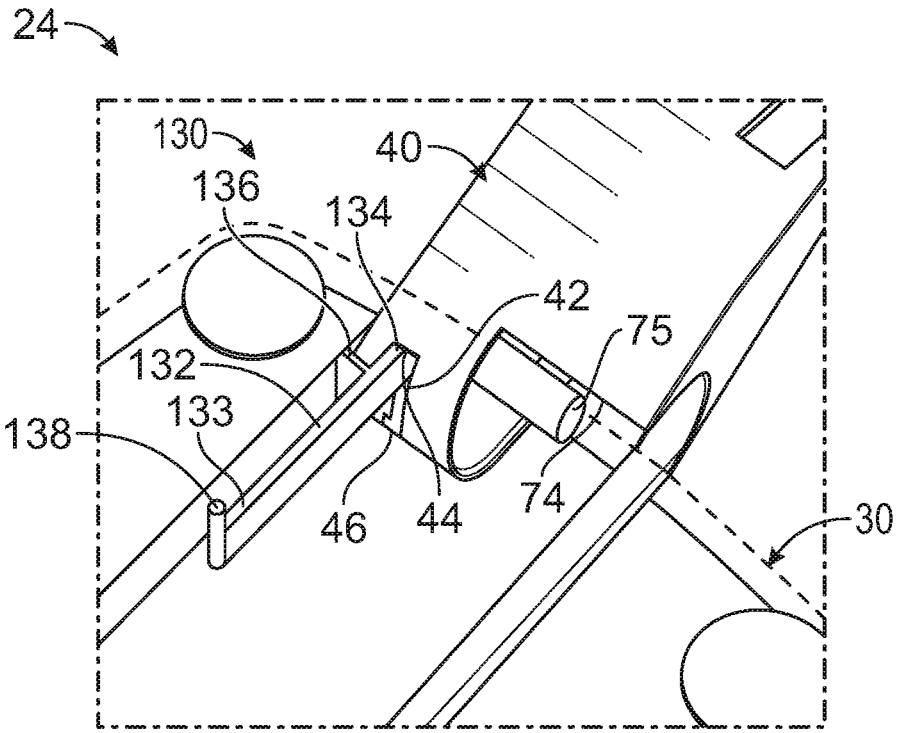
FIG. 13 is a perspective view of a second locking mechanism of the exercise device of FIG. 1 in the use position.
Figure 14:
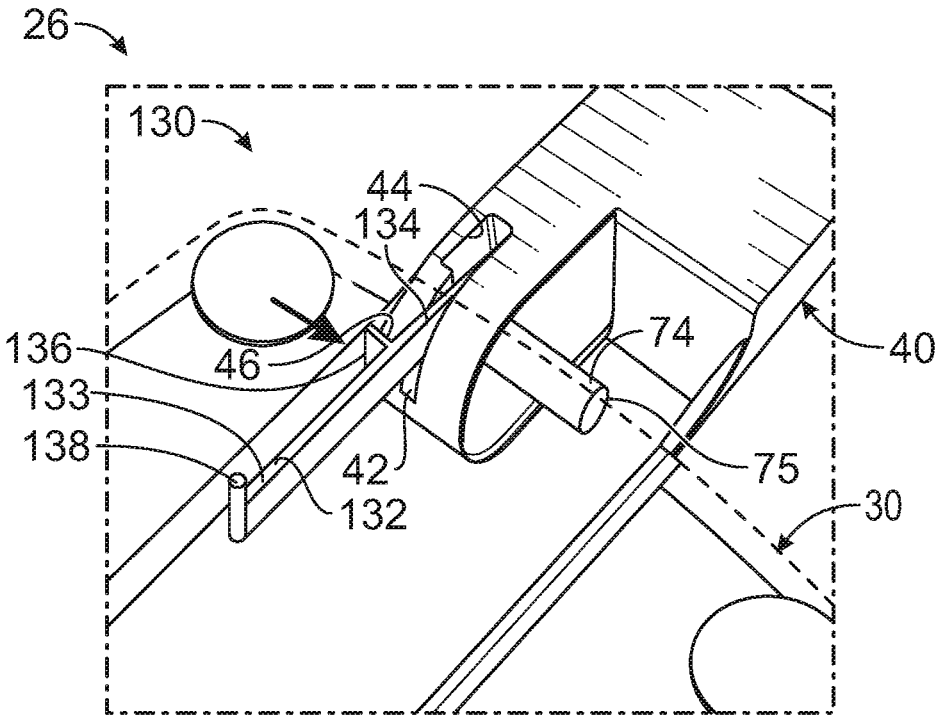
FIG. 14 is a perspective view of the second locking mechanism of the exercise device of FIG. 1 in the folded position.

As shown in FIGS. 13-14, the second locking mechanism 130 includes the second control 132 that includes a body 133 extending between a locking end 134 and a pivot end 138. The locking end 134 is configured to be received within a slot 42 defined by the crank support 40 and interlock with an upper notch 44 or a lower notch 46 that are each positioned along the length of the slot 42 of the crank support 40 (as shown in FIG. 14). The upper notch 44 and the lower notch 46 are positioned along the outermost side of the slot 42 (i.e., further from the middle of the exercise device 20) and are on opposite ends of the slot 42 from each other. The pivot end 138 is configured to pivotably attach the second control 132 to another component (such as an inner portion of the base 30). The second control 132 also includes a control extension 136 that is positioned along the length of the body 133 (between the locking end 134 and the pivot end 138) and extends outwardly from the body 133 in order to extend through the outer shell of the base 30 (as shown in FIG. 4) to provide an area for the user to directly interact with (to activate the second locking mechanism 130). The body 133 of the second control 132 may be biased or spring loaded to automatically pivot about the pivot end 138 away from the middle of the base 30. Accordingly, the second control 132 (in particular the body 133) may be a leaf spring or may include a spring (such as a compression spring) or rubber pad to bias the second control 132 away from the center of the base 30 and toward the notches 44, 46.

In FIG. 13, the exercise device 20 (in particular the crank support 40) is in the use position 24. Accordingly, the locking end 134 of the second control 132 is positioned within and interlocking with the upper notch 44 of the crank support 40, thereby locking the crank support 40 in position relative to the base 30. By pressing the control extension 136 of the second control 132 toward the base 30 (in the direction of the arrow shown in FIG. 14), the body 133 of the second control 132 rotates about a pivot axis along the pivot end 138 in a direction further toward the middle of the base 30. This movement allows the locking end 134 of the body 133 to move out from and disengage the upper notch 44 of the crank support 40 and move into the slot 42, thereby allowing the crank support 40 to move and rotate relative to the base 30. The user can then rotate the crank support 40 downward about the countershaft rotational axis 79 to be in a horizontal position at approximately the same height as the base 30 (rather than in a substantially vertical position, extending upwardly from the base 30 in the use position 24) and into the folded position 26. After the crank support 40 is lowered (and the control extension 136 is released), the body 133 pivots outwardly about the pivot end 138, allowing the locking end 134 of the body 133 to pivot into and interlock with the lower notch 46, which locks the crank support 40 in the folded position 26.

According to various other embodiments (as shown, for example, in FIGS. 16-17), the exercise device 20 may only be partially folded and moved between the use position 24 and the compact position 25. Accordingly, the crank support 40 and the base 30 are constructed as a single, unitary component that cannot be separated without destruction. In this embodiment, the crank support 40 does not move relative to the base 30. Therefore, this configuration does not require the second locking mechanism 120 to move and lock the crank support 40. Instead, the crank support 40 is positioned upright in the use position 24. The exercise device 20, however, may still be movable back and forth between the use position 24 and the compact position 25 in order to fit into a smaller box or space during shipping and/or for storage. In particular, the cranks 62 can still be moved from the use position 24 into the compact position 25 with the first locking mechanism 110 for storage (such that the cranks 62 are folded downward and aligned with each other, rather than being 180° apart from each other) and back to the use position 24, as described further herein.

Figure 19:
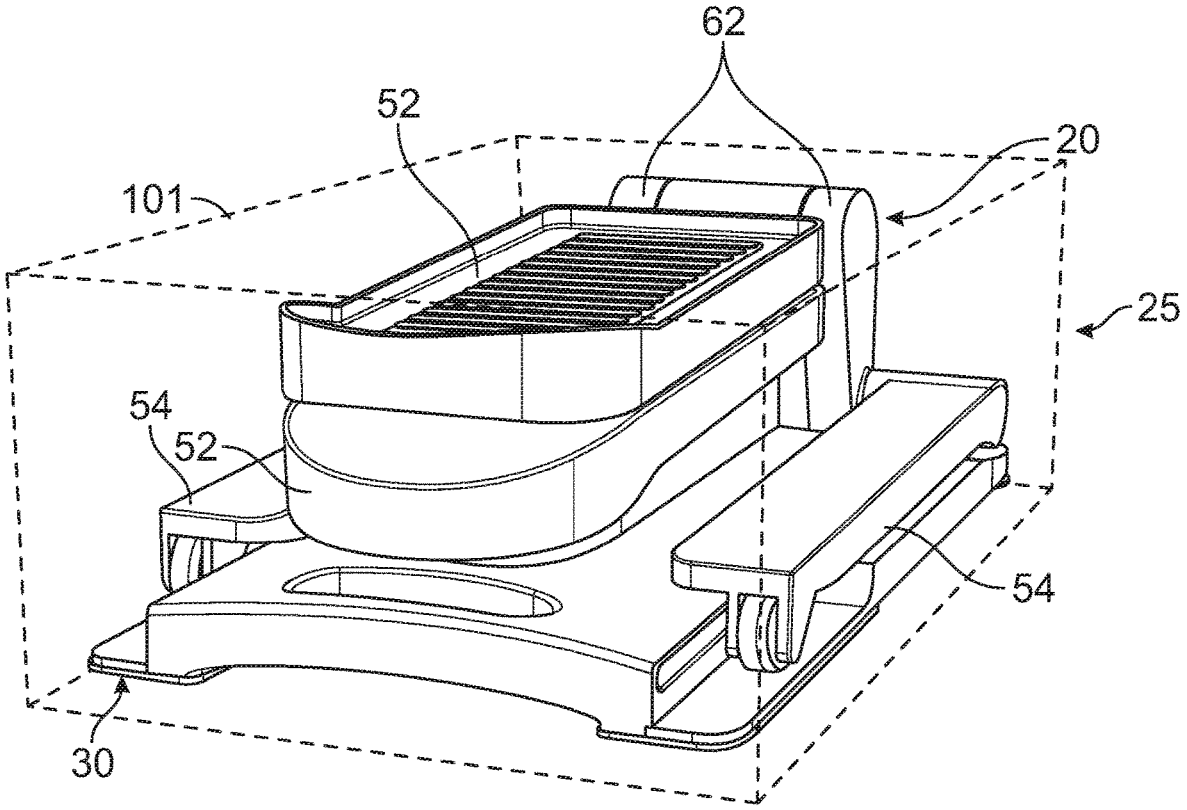
FIG. 19 is a perspective view of the exercise device of FIG. 16 in a box and with the foot pedals removed and place on top of the base.
Figure 20:
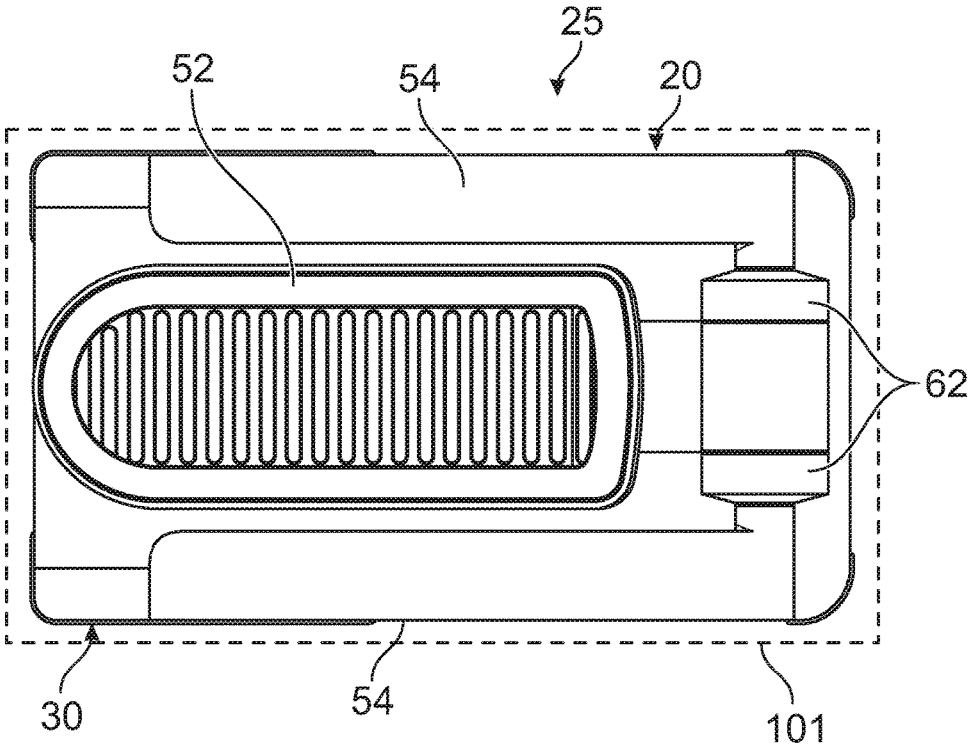
FIG. 20 is a top view of the exercise device and box of FIG. 19.
Figure 21:
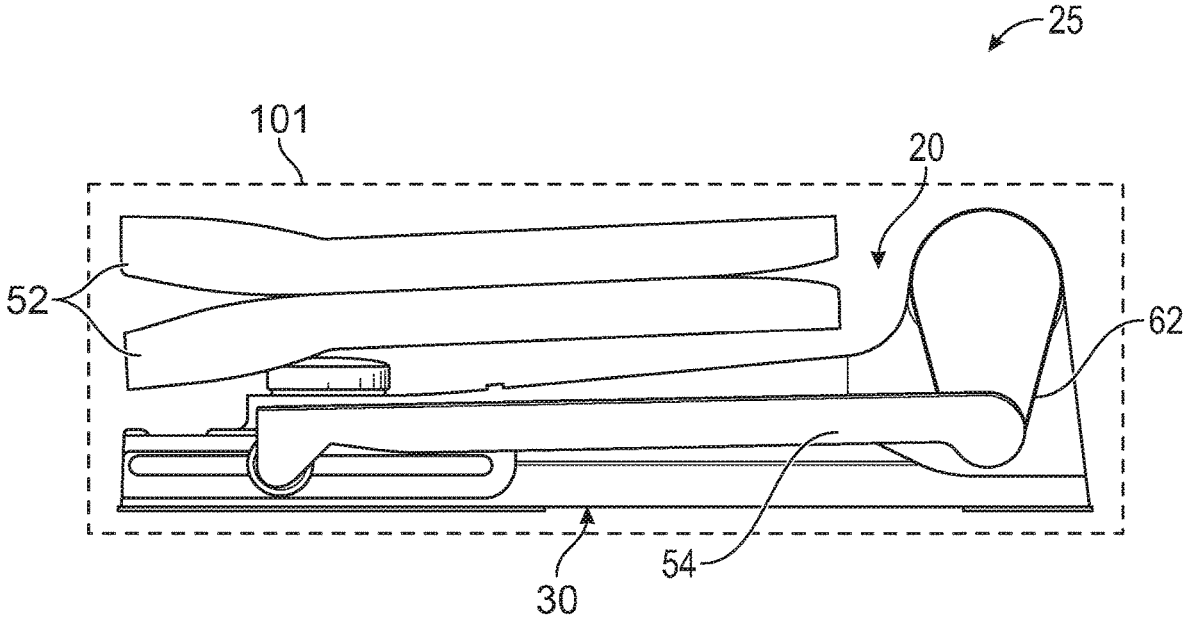
FIG. 21 is a side view of the exercise device and box of FIG. 19.

Alternatively, rather than being movable between the use position 24 and the compact position 25, the cranks 62 may only be in the compact position 25 when packaged (for, for example, shipment) to fit within a smaller space or box (as shown in FIGS. 19-21) while maintaining a simple overall mechanism. Once the user receives the exercise device 20, the user can then move or rotate one of the cranks 62 upwards to its proper position to be 180° offset from the other crank 62 and then secure or fasten the crank 62 to the crankshaft 64 in this position (by, for example, tightening at least one fastener) such that the entire exercise device 20 is in the use position 24. This configuration simplifies the overall mechanism of the exercise device 20 and does not require, for example, the first locking mechanism 110 (to release the crank 62 into the compact position 25) or the second locking mechanism 130 (to move and lock the crank support 40).

As shown in FIG. 1, the base 30 includes or defines a handle 32 along one longitudinal end of the base 30 that opposite the end of the base 30 that the crank support 40 is positioned along, between the two foot pedals 52. By positioning the handle 32 along this longitudinal end of the base 30, the exercise device 20 may be carried and stored vertically, which is particularly beneficial for users living or working in small spaces (e.g., small apartments or small cubicles). For example, as shown in FIG. 15, the exercise device 20 can be stored vertically on a wall 11 (by hooking onto a hook on the wall 11 through the handle 32, which extends completely through the base 30 as an elongated aperture). The exercise device 20 may also be positioned and stored vertically on a stand. Additionally, the user can more easily reposition (or "micro-position") the exercise device 20 with the handle 32 positioned along this longitudinal end, which is particularly helpful if the exercise device 20 is positioned under another structure, such as a table or desk.

In order to prevent the foot pedals 52 and the foot pedal supports 54 from inadvertently moving (in particular while the exercise device is being stored in the vertical position as shown in FIG. 17), the extension 57 is configured to extend into and be retained by the slot 38 of the base 30, both during use and in storage. During use, the extension 57 moves within and along the length of the slot 38 as the wheels 56 of the foot pedal assembly 50 roll along the longitudinal length of the base 30 (where the wheels 56 are outside of and next to the slots 38 and on top of the extension 39 of the base 30) and as the foot pedal supports 54 and the foot pedals 52 are moved during exercise use. The extension 57 also moves within and along the length of the slot 38 as the exercise device 20 is moved between the use position 24, the compact position 25, and the folded position 26. When being stored, the slots 38 help retain the foot pedals 52 in position and prevent the foot pedals 52 from flipping or moving downwardly or backwards when the exercise device 20 is lifted and positioned (e.g., being carried or stored) vertically or upright, as shown in FIG. 17.

According to various embodiments as shown in FIGS. 18-21, the foot pedals 52 may be removable from (and reattachable to) the foot pedal supports 54 to allow the exercise device 20 to have a compact configuration during shipping (and optionally during storage). The removed or detached foot pedals 52 can then be aligned with each other, placed on top of each other, and positioned together in a center area of the exercise device 20 (between the foot pedals supports 54 and on top of the base 30). FIGS. 19-21 show how the exercise device 20 can then be positioned compactly within, for example, a storage or shipping box 101, where the length, width, and height of the overall exercise device 20 are equal to the length, width, and height of the base 30 (with the crank support 40). Accordingly, in such a compact configuration, the foot pedals 52 do not add to the overall size (i.e., the length, width, and height) of the exercise device 20. Once the user receives the exercise device 20 (or would like to use the exercise device 20), the user can install the foot pedals 52 by attaching each of the foot pedals 52 to the respective one of the foot pedal supports 54. The foot pedals 52 may be attached to the foot pedals supports 54 with, for example, fasteners (such as two screws to attach each foot pedal 52 to a foot pedal support 54) or by snapping the foot pedals 52 onto the foot pedal supports 54.

The position of the foot pedal 52 along the foot pedals support 54 may also be adjustable along the length of the foot pedal support 54, which affects the foot pedal motion. For example, the user may position and attach the foot pedal 52 to the foot pedal support 54 in a variety of different locations along the longitudinal length of the foot pedal support 54.

The particular arrangement, mechanism, and configuration of the various components of the exercise device 20 may vary according to the desired configuration, as shown in FIGS. 22-24 and FIGS. 27-31. For conciseness, each of the components of the various embodiment (such as the embodiment shown in FIGS. 22-24 and FIGS. 27-31) are described in full with respect to other embodiments herein and may have any of the features, aspects, configurations, and elements of any of the other embodiments described herein (and vice versa), except where noted otherwise. In the various embodiments, some of the components (including but not limited to the foot pedals 52 and the foot pedal supports 54) are not shown for clarity, but are otherwise included in the exercise device 20. In the embodiment shown in FIGS. 22-24, some of the components, such as various axles, are not shown for clarity of the rest of the configuration.

According to various embodiments as shown in FIGS. 25-26B, 28, and 34A, the exercise device 20 includes a resistance adjustment assembly 140 that is configured to adjust the rotational resistance applied to the flywheel 96, and thus the force required to move the foot pedals 52, according to the user's preferences. The resistance adjustment assembly 140 includes a resistance control (which is referred to herein as a knob 34, although other types of controls may be used) that allows the user to change or adjust the rotatable resistance of the flywheel 96. The knob 34 may optionally be a part of (or positioned along) the base 30 and may have a plurality of settings (for example, eight settings) that provide different levels of resistance. Alternatively, the resistance control may include a servo motor that is configured to change the resistance of the flywheel 96 and is controlled remotely with an electronic device (e.g., with a smartphone or app). The base 30 (and/or the resistance adjustment assembly 140) may include a display 36 (as shown in FIG. 2) that provides feedback or information to the user, such as the amount of applied resistance, the time, and/or the speed.

The resistance adjustment assembly 140 may include a variety of different mechanisms (as shown in various embodiments) to adjust the resistance applied to the flywheel 96. Each of the resistance adjustment assemblies 140 disclosed herein includes at least one magnet 141, a cable 142, and a cable housing 143 that the cable 142 is positioned within. The resistance adjustment assembly 140 controls the resistance applied to the flywheel 96 by moving the magnet 141 relative to the flywheel 96. Accordingly, the flywheel 96 includes a magnetic portion 97, which may be the outer rim or edge of the flywheel 96. As the user adjusts or rotates the knob 34, the knob 34 moves the magnet 141 closer to or further from the magnetic portion 97 of the flywheel 96, the resistance on the flywheel 96 is increased or decreased, respectively. A first end of the cable 142 is statically attached to a portion of the knob 34 such that turning the knob 34 either lengthens or shortens the cable 142, which moves the magnet 141 relative to the magnetic portion 97 of the flywheel 96 and thus increases or decreases the resistance on the flywheel 96 (depending on which way the knob 34 is turned and the configuration of the rest of the resistance adjustment assembly 140).

Figure 25:
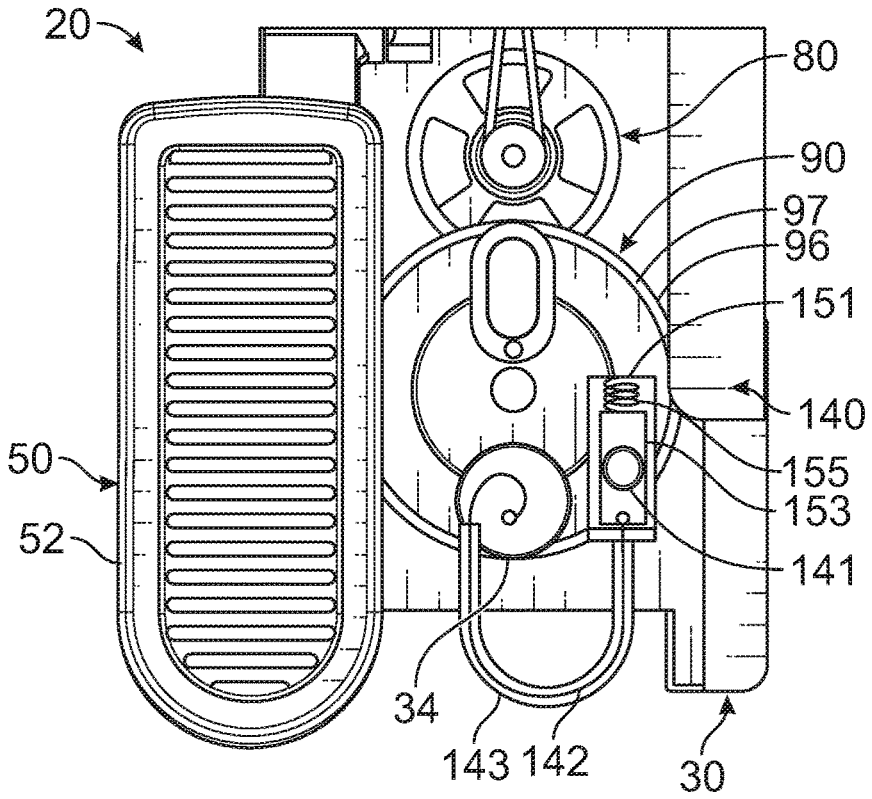
FIG. 25 is a top view of the exercise device of FIG. 22 with a resistance adjustment assembly according to one embodiment.

According to one embodiment as shown in FIG. 25, the resistance adjustment assembly 140 includes a fixed bracket 151, a slidable or movable bracket 153, and a spring 155. The fixed bracket 151 is statically attached to the base 30, the magnet 141 is statically attached to the movable bracket 153, and the movable bracket 153 is movably attached to the fixed bracket 151 in order to move the magnet 141 closer to or further from the magnetic portion 97 of the flywheel 96. The fixed bracket 151 and the movable bracket 153 are positioned at least partially over or near the magnetic portion 97 of the flywheel 96. The second end of the cable 142 is attached to the movable bracket 153, and an end of the cable housing 143 is attached to the fixed bracket 151. The spring 155 is positioned between a portion of the movable bracket 153 and the fixed bracket 151 and biases the movable bracket 153 in a direction away from the knob 34 along the length of the cable 142.

Accordingly, as the user rotates the knob 34, the cable 142 is tightened or loosened (depending on the direction of rotation of the knob 34), which moves the movable bracket 153 relative to the fixed bracket 151 in opposite directions. As the movable bracket 153 moves, the magnet 141 also moves with the movable bracket 153 relative to the magnetic portion 97 of the flywheel 96. The closer that the magnet 141 is to the magnetic portion 97 (or the more that the magnet 141 overlaps with the magnetic portion 97), the greater resistance is applied to the flywheel 96. Conversely, the further that the magnet 141 is from the magnetic portion 97 (or the less that the magnet 141 overlaps with the magnetic portion 97), the less resistance is applied to the flywheel 96.

Figure 26A:
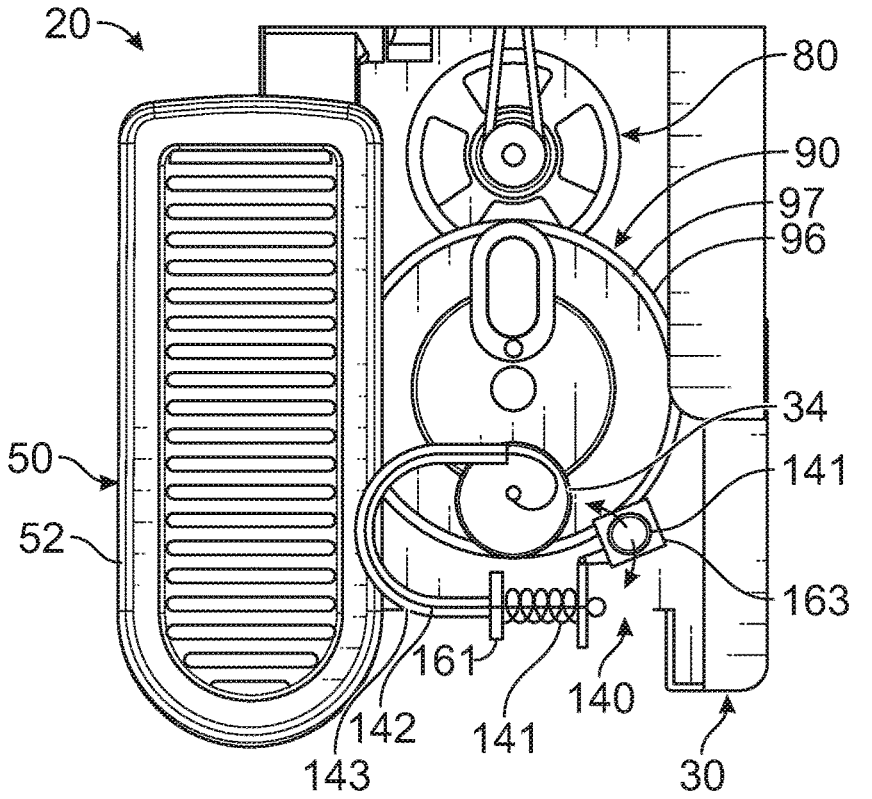
FIG. 26A is a top view of the exercise device of FIG. 22 with a resistance adjustment assembly according to another embodiment.
Figure 26B:
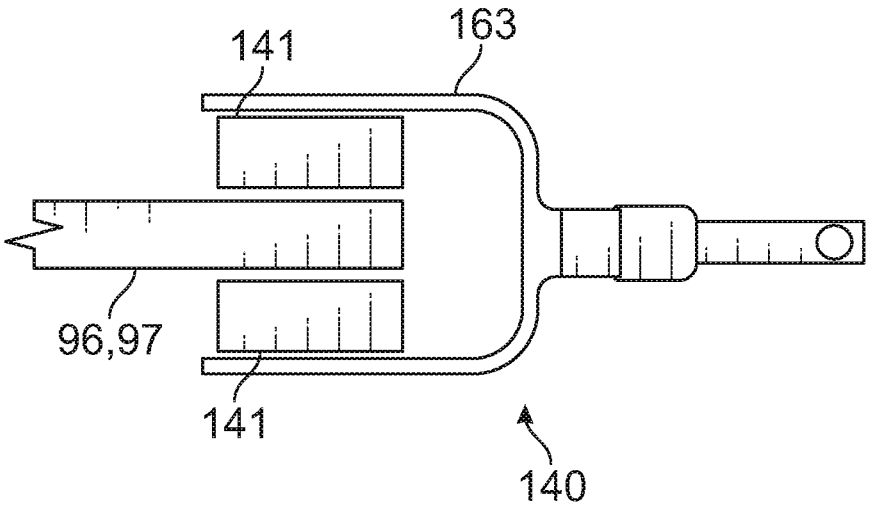
FIG. 26B is a cross-sectional view of a portion of a resistance adjustment assembly of FIG. 26A.

According to another embodiment as shown in FIGS. 26A-26B, the resistance adjustment assembly 140 includes a fixed bracket 161, a movable bracket or caliper 163, and a spring 165. The fixed bracket 161 is statically attached to the base 30, the magnets 141 are statically attached to opposite sides of the caliper 163 to be positioned above and below the flywheel 96, and the caliper 163 is movably attached to the base 30 (and/or the fixed bracket 151) in order to move the magnets 141 closer to or further from the magnetic portion 97 of the flywheel 96. As shown in FIG. 26B, the caliper 163 extends along (and positions two magnets 141 along) a portion of the top side and the bottom side of the magnetic portion 97 of the flywheel 96. The second end of the cable 142 is attached to an end of the caliper 163, and an end of the cable housing 143 is attached to the fixed bracket 161. The spring 165 is positioned between the fixed bracket 151 and the end of the caliper 163 and biases the caliper 163 in a direction away from the knob 34 along the length of the cable 142. The cable 142 may extend through or next to the spring 175.

Accordingly, as the user rotates the knob 34, the cable 142 is tightened or loosened (depending on the direction of rotation of the knob 34), which moves (and optionally rotates) the caliper 163 relative to the fixed bracket 161 in opposite directions. As the caliper 163 moves, the magnets 141 also move relative to the magnetic portion 97 of the flywheel 96. The more that the magnets 141 overlap with the magnetic portion 97, the greater resistance is applied to the flywheel 96. Conversely, the less that the magnets 141 overlap with the magnetic portion 97, the less resistance is applied to the flywheel 96.

Figure 28:
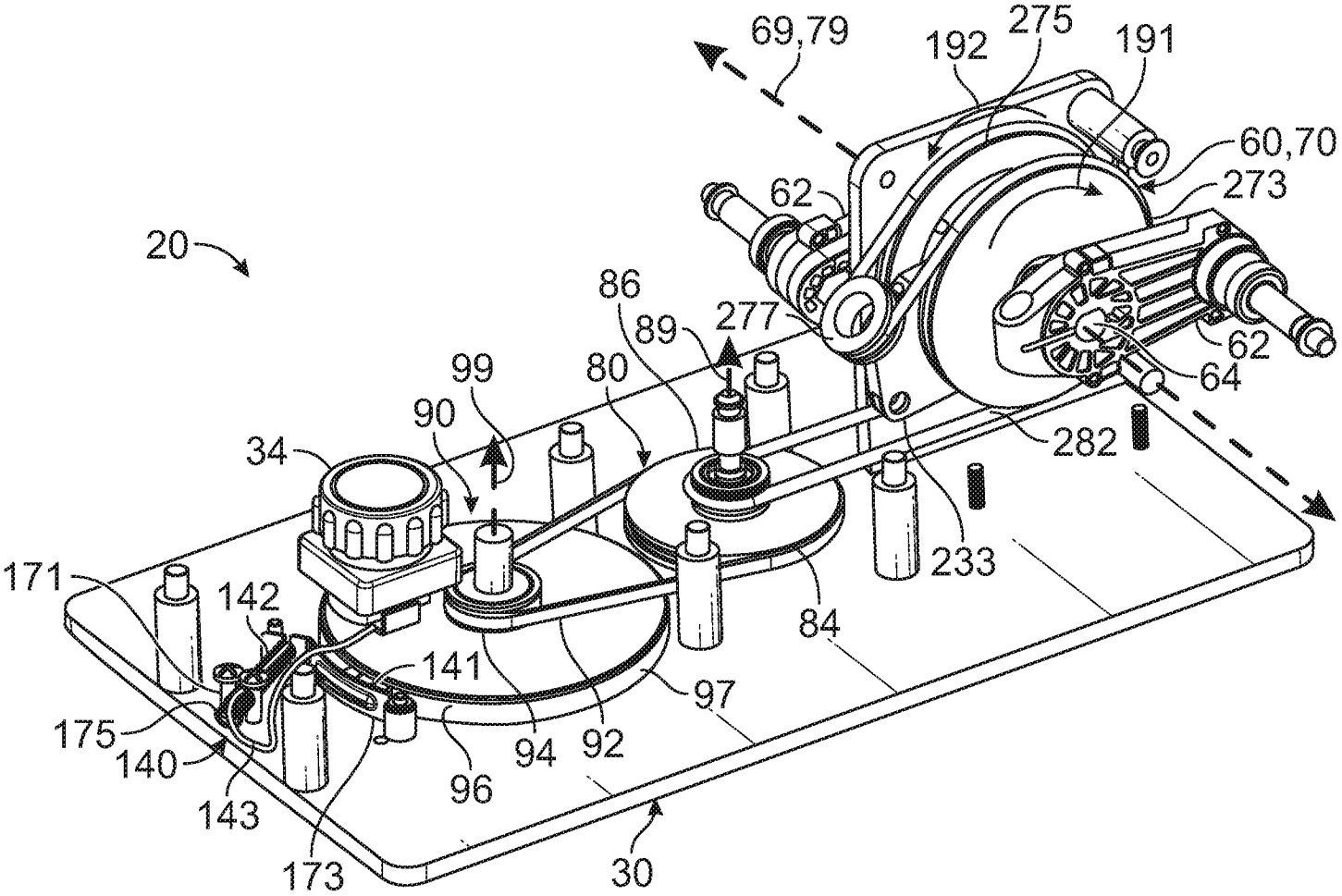
FIG. 28 is a perspective view of the exercise device of FIG. 27 (with additional components not shown for clarity).
Figure 30A:
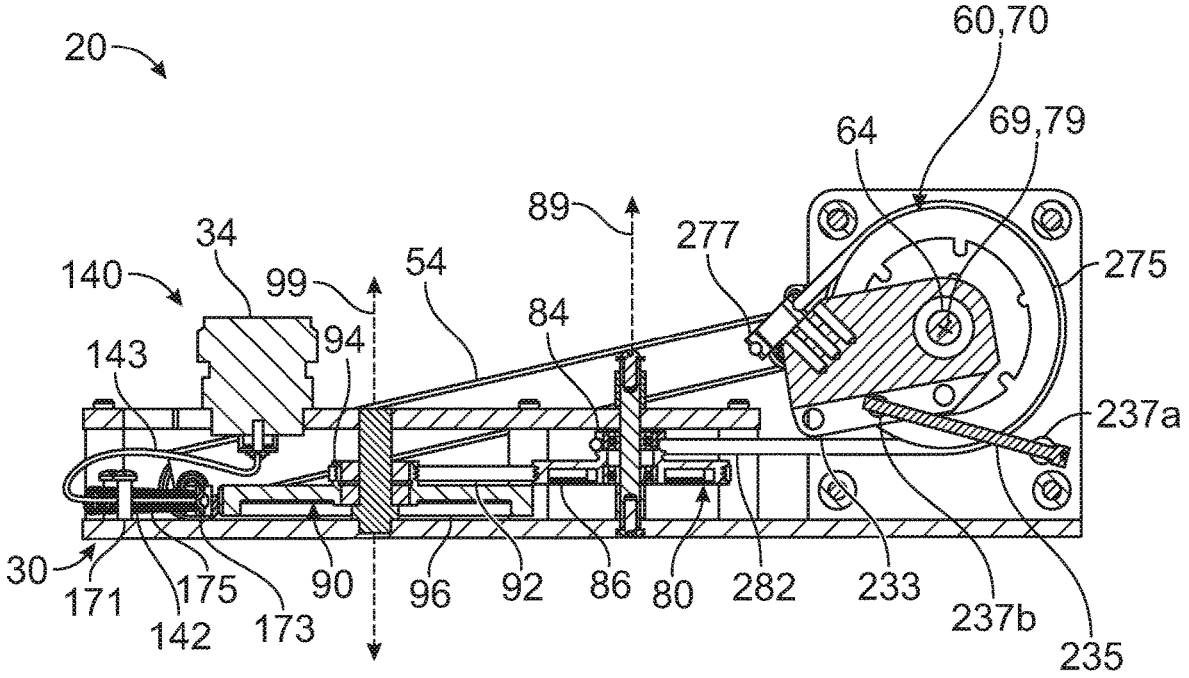
FIG. 30A is a cross-sectional view of the exercise device of FIG. 28 in a position in which a pulley belt is relatively less tense.

According to another embodiment as shown in FIGS. 28 and 30A, the resistance adjustment assembly 140 includes a fixed bracket or anchor 171, a movable bracket 173, and a spring 175. The anchor 171 is statically attached to the base 30 and may be, for example, two fasteners (e.g., screws) attached to the base 30. The magnets 141 are statically attached to an inside surface of the movable bracket 173 to face toward the outer edge of the flywheel 96. The movable bracket 173 extends along a portion of the outer circumference of the flywheel 96 (along the magnetic portion 97). The second end of the cable 142 is attached to a first end of the movable bracket 173, and an end of the cable housing 143 is attached to the anchor 171. A second end of the movable bracket 173 is movably or pivotably attached to the base 30 in order to move closer to or further from the magnetic portion 97 of the flywheel 96. As shown in FIG. 28, the movable bracket 173 curves or extends along (and positions magnets 141 along) an outer edge of the flywheel 96 (which corresponds to the magnetic portion 97 of the flywheel 96). At least a portion of the spring 165 is positioned between and attached to the anchor 171 and the second end of the movable bracket 173 and biases the movable bracket 173 in a direction away from the knob 34 along the length of the cable 142.

Accordingly, as the user rotates the knob 34, the cable 142 is tightened or loosened (depending on the direction of rotation of the knob 34), which moves the movable bracket 173 relative to the anchor 171 in opposite directions. As the movable bracket 173 moves, the magnets 141 also moves relative to the magnetic portion 97 of the flywheel 96. The closer that the magnets 141 are to the magnetic portion 97, the greater resistance is applied to the flywheel 96. Conversely, the further that the magnets 141 are from the magnetic portion 97, the less resistance is applied to the flywheel 96.

FIGS. 27-31 show another embodiment of the exercise device 20 in which the exercise device 20 only includes two belts (rather than three belts, as shown in FIGS. 3-4, for example). In particular, the exercise device 20 of FIG. 27 does not include the transfer belt 72 (that rotatably connects the crankshaft 64 and the countershaft 74 in FIGS. 3-4) and does not include a countershaft 74. Instead, the transfer assembly 70 comprises the crankshaft 64 (as described further herein), a drive pulley or wheel 273, and an idler wheel 275. The cranks 62 are fixed or attached to the crankshaft 64, as described further herein. The drive wheel 273 is fixed to a middle portion of the crankshaft 64 (such that the drive wheel 273 and the crankshaft 64 rotate congruently). The drive wheel 273 may be fixed to the crankshaft 64 by being welded to, molded with, or fastened onto (e.g. bolted to) the crankshaft 64. The idler wheel 275 is rotatably attached to the middle portion of the crankshaft 64 such that the idler wheel 275 can freely rotate relative to and on the crankshaft 64 (and relative to the drive wheel 273). Accordingly, the idler wheel 275 comprises a bearing to allow the idler wheel 275 to rotate relative to (and to attach to) the crankshaft 64. This configuration allows the drive wheel 273 and the idler wheel 275 to rotate in opposite directions during use. The drive wheel 273 and the idler wheel 275 have the same outer diameter and may be axially spaced apart from each other along the axial length of the crankshaft 64. The drive wheel 273 and the idler wheel 275 are vertically oriented such that they extend radially vertically and rotate about a horizontal axis (i.e., the crank rotational axis 69 and the transfer rotational axis 79).

Figure 29:
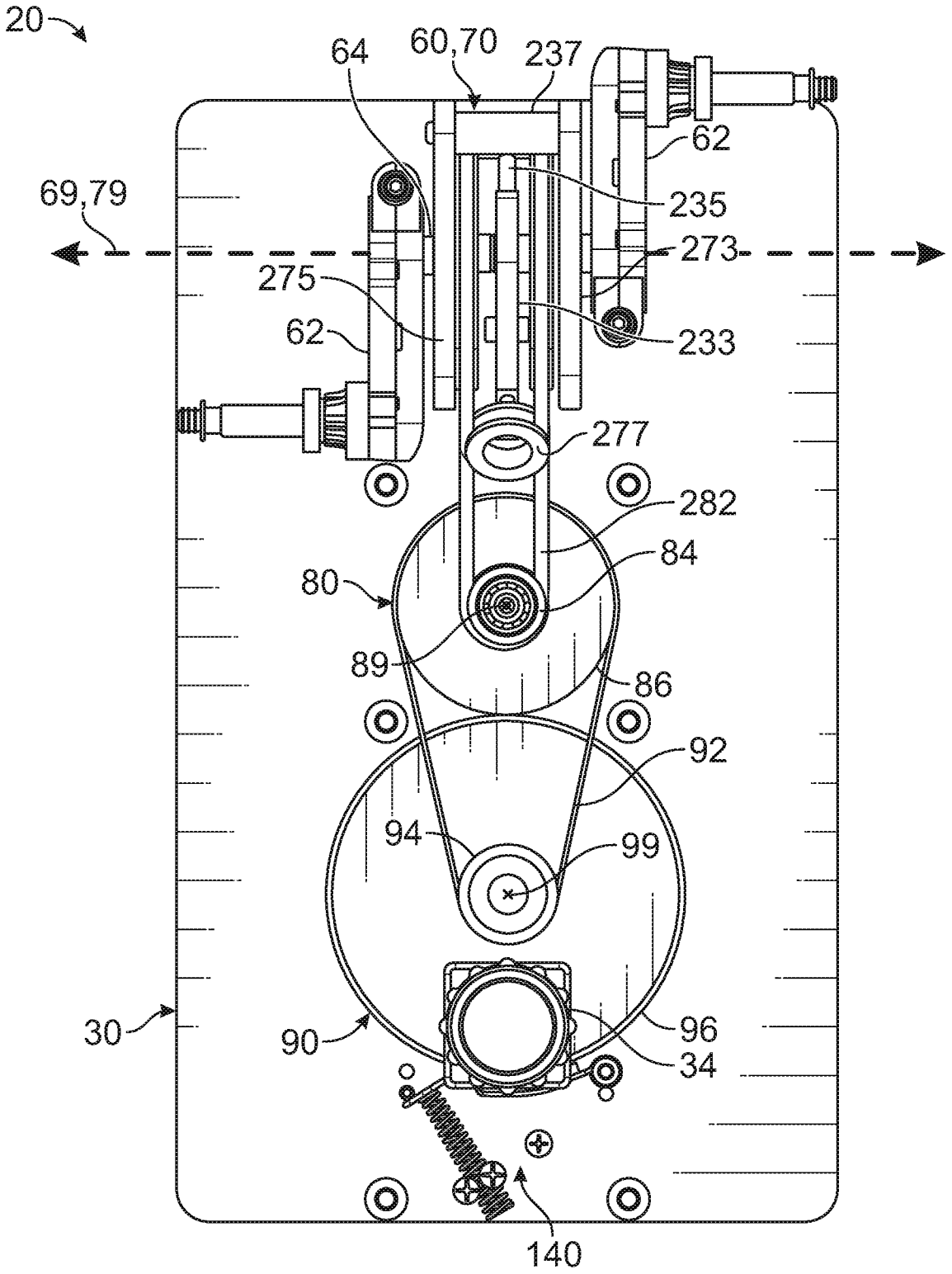
FIG. 29 is a top view of the exercise device of FIG. 28.

The pulley hub 84 is aligned with the drive wheel 273 and the idler wheel 275 to allow the pulley belt 282 (as described further herein) to smoothly transfer between the drive wheel 273, the pulley hub 84, and the idler wheel 275. For example, as shown in FIG. 29, the drive wheel 273 and the idler wheel 275 are spaced apart by a distance that is approximately equal to the outer diameter of the pulley hub 84. Furthermore, as shown in FIG. 30A, the bottom of the drive wheel 273 and the bottom of the idler wheel 275 are vertically aligned with the portion of the pulley hub 84 that receives the pulley belt 282.

Figure 27:
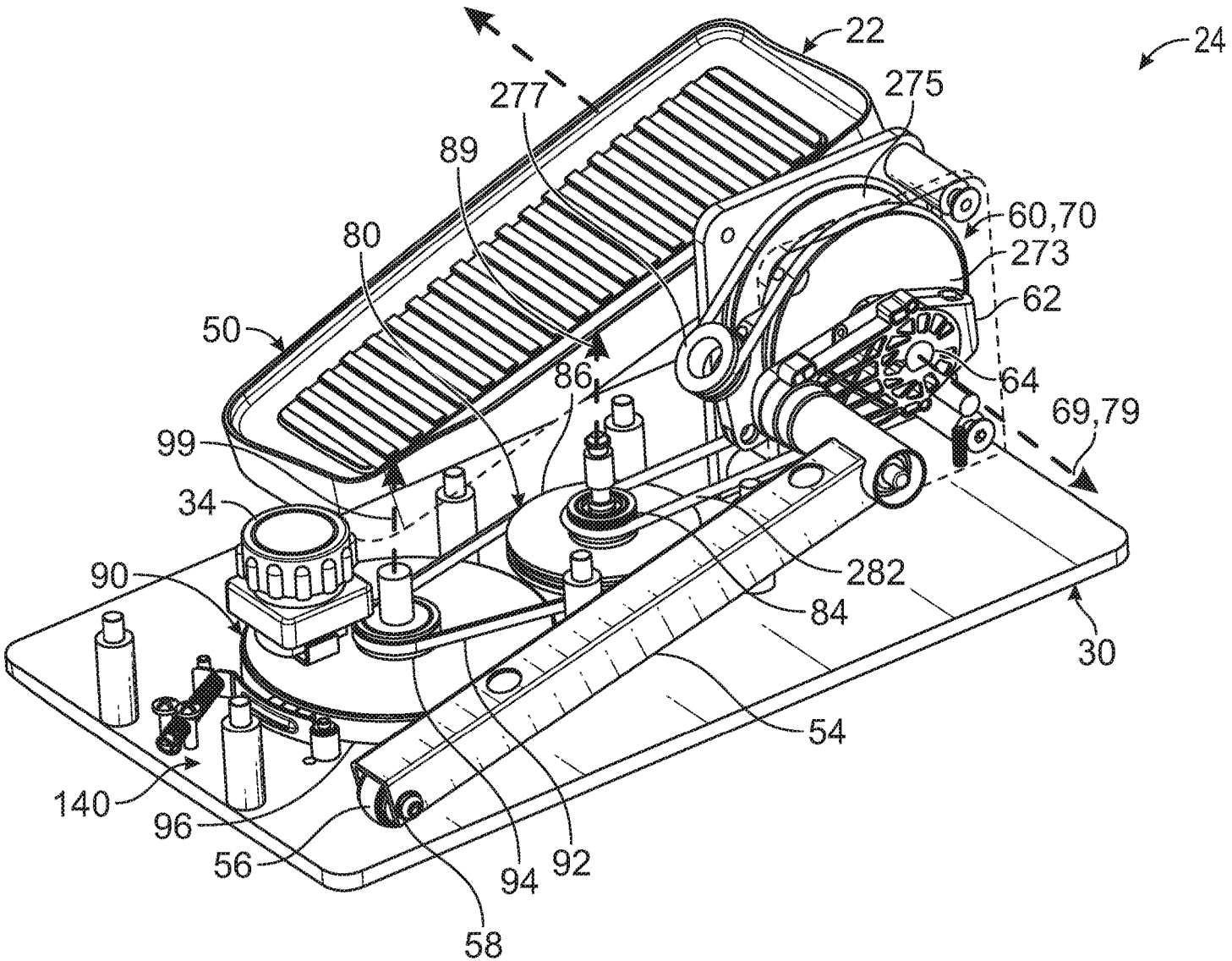
FIG. 27 is a perspective view of an exercise device according to another embodiment (with certain components not shown for clarity).

Accordingly, the crank assembly 60 and the transfer assembly 70 are positioned together (rather than separate, as shown in the embodiment of FIGS. 3-4). In the embodiment of FIG. 27, the crank assembly 60 and the transfer assembly 70 share a common axis, and the transfer rotational axis 79 (which is also referred to as the countershaft rotational axis) coincides with and is the same as the crank rotational axis 69. The drive wheel 273, the idler wheel 275, and the crankshaft 64 rotate about the same axis (i.e., the transfer rotational axis 79 and the crank rotational axis 69).

The pulley assembly 80 comprises a pulley belt 282 (instead of the pulley belt 82) that is a continuous band of material. The pulley belt 282 includes all of the features, aspects, and configuration of the pulley belt 82, unless otherwise specified herein. However, instead of being looped around the countershaft 74 (such that the countershaft 74 being positioned within the loop formed by the pulley belt 82, as shown in FIGS. 3-4), a first end of the pulley belt 282 bends, folds, or extends around a portion of the drive wheel 273 and a portion of the idler wheel 275 (along the folded length of the pulley belt 282). The pulley belt 282 is folded along its length over and around (rather than looping around) the outer circumferences of the drive wheel 273 and the idler wheel 275. Accordingly, the drive wheel 273 and the idler wheel 275 are not positioned within the loop formed by the pulley belt 282, but instead are alongside the length of the pulley belt 282. A second end of the pulley belt 282, however, is looped and extends around a portion of the outer circumference of the pulley hub 84 such that the pulley hub 84 is positioned within the loop formed by the pulley belt 282 (as described further herein in reference to the pulley belt 82).

In use, as the user moves the foot pedals 52, the crankshaft 64 rotates (as described further herein) in the direction of the arrow 191 (as shown in FIG. 28). Since the crankshaft 64 and the drive wheel 273 rotate congruently, the drive wheel 273 is rotated as a result, also in the direction of the arrow 191. Movement of the drive wheel 273 causes the pulley belt 282 to move with the drive wheel 273 in the same direction. The movement of the pulley belt 282 causes the idler wheel 275 to move with the pulley belt 282. Since the pulley belt 282 folds around the drive wheel 273 and the idler wheel 275 (rather than the drive wheel 273 and the idler wheel 275 being positioned within the loop of the pulley belt 282), the pulley belt 282 rotates the idler wheel 275 in the opposite direction as the drive wheel 273 and the crankshaft 64, as depicted by arrow 192 in FIG. 28.

The particular configuration of the drive wheel 273, the idler wheel 275, and the pulley belt 282 allows the pulley belt 282 to be aligned with the various components within the exercise device 20 as the pulley belt 282 transfers the rotation about a horizontal axis (i.e., the crank rotational axis 69 and the transfer rotational axis 79) to rotation about a vertical axis (i.e., the pulley rotational axis 89). Furthermore, this particular configuration reduces the number of shafts within the exercise device 20. In summary, the pulley belt 282 accomplishes a 90° change in rotation direction with perfect belt alignment and keeping within the intended form of the exercise device (and while also allowing the tension of the pulley belt 282 to be adjustable, as described below).

In particular, the transfer assembly 70 comprises a tensioner pulley 277 (which may be referred to as a rotatable pulley belt support) that is configured to secure and support the first end of the pulley belt 282 (while allowing the pulley belt 282 to move). The first end of the pulley belt 282 is looped and extends partially around the tensioner pulley 277 (such that the tensioner pulley 277 is positioned within the loop formed by the pulley belt 282). The tensioner pulley 277 can freely rotate about its own shaft and with the pulley belt 282 as the pulley belt 282 moves.

Figure 30B:
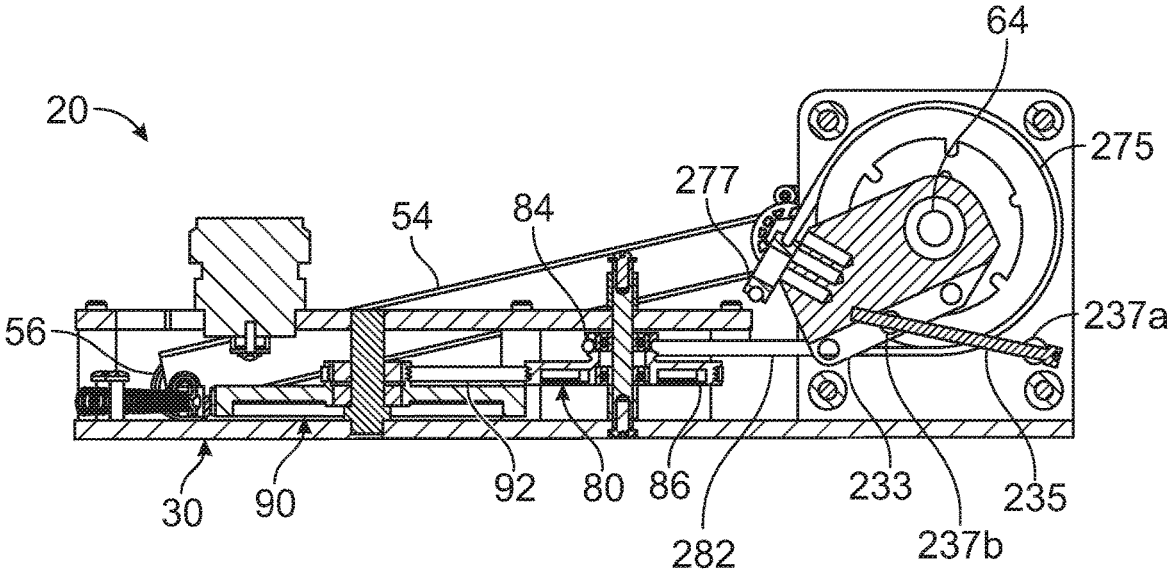
FIG. 30B is a cross-sectional view of the exercise device of FIG. 28 in a position in which the pulley belt is relatively more tense.
Figure 31:
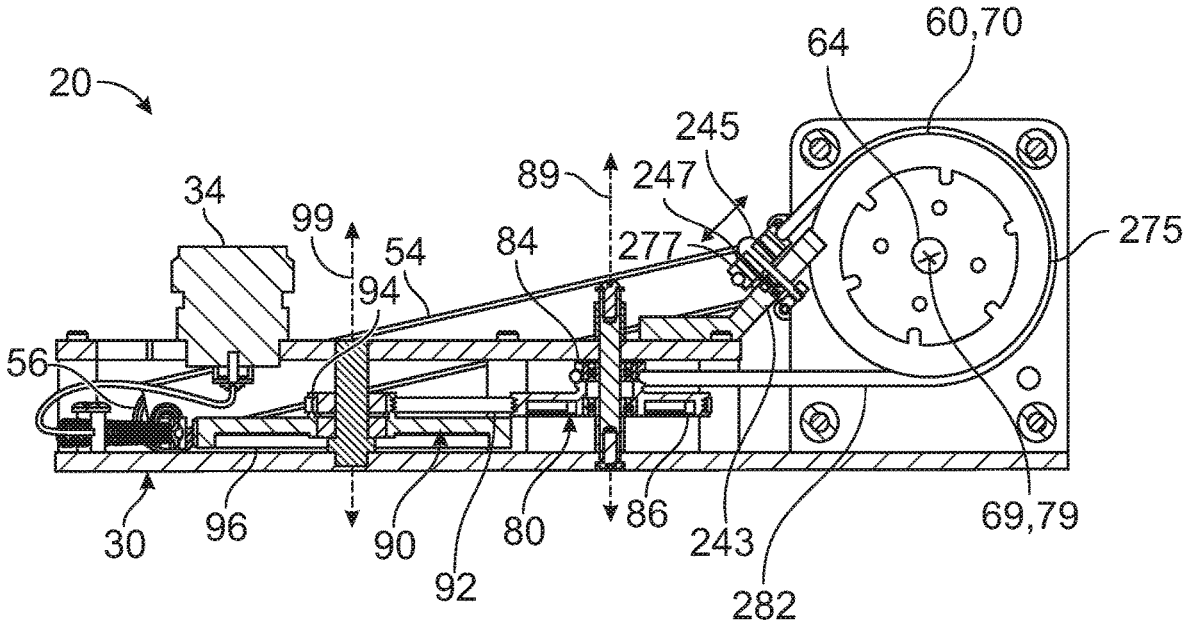
FIG. 31 is a cross-sectional view of an exercise device according to another embodiment.

The tensioner pulley 277 is also configured to change, adjust, and optimize the tension of the pulley belt 282 by moving relative to the crankshaft 64, in particular at least partially around the drive wheel 273, the idler wheel 275, and the crank rotational axis 69 (as shown in FIGS. 30A-30B) or by moving closer to or further from the drive wheel 273 and the idler wheel 275 (as shown in FIG. 31). Alternatively, the tensioner pulley 277 may be hard mount within the exercise device 20 such that the tension of the pulley belt 282 is not adjustable.

According to one embodiment as shown in FIGS. 30A-30B, the transfer assembly 70 comprises a pivotable plate 233, an adjustment rod 235, and first and second rod attachment portions 237*a*, 237*b* that are configured to move the tensioner pulley 277 to change the tension of the pulley belt 282. The tensioner pulley 277 is rotatably fixed to the pivotable plate 233 (such that the tensioner pulley 277 moves with the pivotable plate 233 and can also rotate relative to the pivotable plate 233) via, for example, a bearing. The pivotable plate 233 is positioned axially between the drive wheel 273 and the idler wheel 275 and is rotatably attached to the crankshaft 64. The two rod attachment portions 237*a*, 237*b* are configured to rotatably attach the adjustment rod 235 to the pivotable plate 233 and the base 30, respectively. Accordingly, the first rod attachment portions 237*a* is attached or fixed to the base 30 (such as to a sidewall of the base 30) and positioned along a first end of the adjustment rod 235. The second rod attachment portion 237*b* is attached or fixed to the pivotable plate 233 and positioned along the second end of the adjustment rod 235.

A portion of the adjustment rod 235 extends through each of the rod attachment portions 237*a*, 237*b*. The outer surface of the adjustment rod 235 and the inner surface of one of the rod attachment portions 237*a*, 237*b* have complementary threads. The inner surface of the other of the rod attachment portions 237*a*, 237*b* does not have inner threads. Since the first rod attachment portion 237*a* is fixed to the base 30, as the adjustment rod 235 is rotated, the second rod attachment portion 237*b* is moved toward or away from the first rod attachment portion 237*a* along the length of the adjustment rod 235, depending on which way the adjustment rod 235 is rotated and due to the threaded attachment. The movement of the second rod attachment portion 237*b* moves or pivots the pivotable plate 233 about the crank rotational axis 69. Since the tensioner pulley 277 is rotatably attached to the pivotable plate 233, the tensioner pulley 277 is moved with the pivotable plate 233 about the crank rotational axis 69. Since the pulley belt 282 extends around the tensioner pulley 277, movement of the tensioner pulley 277 either tightens or loosens the tension of the pulley belt 282 (depending on the direction of movement of the tensioner pulley 277).

Accordingly, when the adjustment rod 235 is rotated in FIG. 30A, the second rod attachment portion 237*b* moves closer to the first rod attachment portion 237*a* along the length of the adjustment rod 235, which rotates the pivotable plate 233 (and thus the tensioner pulley 277) counter-clockwise about the crank rotational axis 69, as shown in FIG. 30B. This movement increases the distance (along the path provided by the pulley belt 282) between the two ends of the pulley belt 282 (at the tensioner pulley 277 and the pulley hub 84), thereby pulling the pulley belt 282 and increasing the tension of the pulley belt 282. By rotating the adjustment rod 235 in the opposite direction, the opposite movement occurs, which decreases the tension of the pulley belt 282.

Alternatively, according to another embodiment as shown in FIG. 31, the transfer assembly 70 comprises a slotted plate 243, a fastener 245, and a bearing 247 that are configured to allow the position of the tensioner pulley 277 to be moved to change the tension of the pulley belt 282. The tensioner pulley 277 is attached to the bearing 247, and the bearing 247 is attached to the slotted plate 243 via the fastener 245. Accordingly, the tensioner pulley 277 is rotatably fixable to the slotted plate 243 (such that the tensioner pulley 277 can rotate relative to the pivotable plate 233).

One end of the slotted plate 243 is fixed to an inner or outer surface of the base 30. The second end of the slotted plate 243 defines a longitudinal slot or at least two through-holes through or along which the fastener 245 can extend to attach the bearing 247 and the tensioner pulley 277 to the slotted plate 243. The fastener 245 can attach or clamp the tensioner pulley 277 and the bearing 247 in place at a plurality of different locations along the length of the slotted plate 243 (e.g., along different areas of the slot or through different through-holes of the slotted plate 243). By changing the position of the tensioner pulley 277, the tensioner pulley 277 is moved closer to or further from the drive wheel 273 and the idler wheel 275, which decreases or increases, respectively, the distance (along the path provided by the pulley belt 282) between the two ends of the pulley belt 282 (at the tensioner pulley 277 and the pulley hub 84), thereby loosening or pulling the pulley belt 282 and decreasing or increasing the tension of the pulley belt 282, respectively.

The various belts (i.e., the transfer belt 72, the pulley belt 82, the pulley belt 282, and the flywheel belt 92) are in a continuous circle or loop and may have a variety of different configurations, such as a substantially round cross-section, a rectangular cross-section, or V-shape cross-section (where the cross-section extends along the width of the belt). The various belts may optionally be ribbed. Furthermore, the outer circumferences of the various wheels, pulleys, and shafts (such as the crankshaft 64, the crankshaft pulley 65, the countershaft 74 (including the first end 73 and the second end 75), the pulley hub 84, the pulley 86, the flywheel hub 94, and the flywheel 96) have a complementary configuration to the respective belt to receive and secure the respective belt. For example, the various wheels, pulleys, and shafts may have a concave (e.g., rounded, flat, or v-grooved) and/or a ribbed outer circumference.

The exercise device 20 and its various components may be constructed out of a variety of different materials. According to one embodiment, the foot pedals 52 are constructed out of polypropylene, the foot pads 53 are constructed out of thermoplastic rubber (TPR), the base 30, the crank support 40, the foot pedal support 54, and the crank 62 are constructed out of glass-filled nylon (such as approximately 43% glass-filled nylon 6/6), the knob 34 is constructed out of acrylonitrile butadiene styrene (ABS), the display 36 may be a (liquid-crystal display) LCD (that is approximately 29 by 55 millimeters (mm)), and the wheels 56 are constructed out of Delrin (with approximately a 32 mm diameter). The flywheel 96 may be constructed out of a variety of metals, such as aluminum and/or steel. At least a portion of the flywheel 96 may be constructed out of a magnetic material to allow the resistance of the flywheel 96 to be changed with a magnet.

Each of the various embodiments disclosed herein may have any of the features, components, aspects, and/or configurations of the other embodiments disclosed herein, unless otherwise specified.

Unless otherwise indicated, all numbers expressing quantities of properties, parameters, conditions, and so forth, used in the specification and claims are to be understood as being modified in all instances by the terms "about," "approximately," and "substantially." Accordingly, unless indicated to the contrary, the numerical parameters set forth in the following specification and attached claims are approximations. Any numerical parameter should at least be construed in light of the number reported significant digits and by applying ordinary rounding techniques. The terms "about," "approximately," and "substantially," when used before a numerical designation, e.g., temperature, time, amount, measurement, and ratios, indicates approximations which may vary by (+) or (−) 10%, 5% or 1%.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. An exercise device comprising:
- a base;
- a crank support movably attached to the base; and
- a rotation assembly movably attached to the base and comprising:
  - an exercise interface assembly comprising at least one exercise support portion configured to be moved by a user,
  - a crank assembly comprising at least one crank rotatably attached to the at least one exercise support portion and configured to be rotated about a crank rotational axis by the at least one exercise support portion,
  - a flywheel assembly comprising a flywheel configured to be rotated about a flywheel rotational axis due to rotation of the at least one crank, wherein the crank rotational axis and the flywheel rotational axis are substantially perpendicular to each other, and
  - a crankshaft that the at least one crank is configured to be fixed to and that is positioned at least partially within the crank support, wherein the crank support is movable relative to the base between a use position and a folded position.

2. The exercise device of claim 1, wherein, when the exercise device is in use, the flywheel rotational axis extends substantially vertically such that the flywheel extends radially horizontally.

3. The exercise device of claim 1, wherein the exercise interface assembly comprises at least one foot pedal attached to the at least one exercise support portion.

4. The exercise device of claim 1, wherein the at least one exercise support portion is configured to move in an elliptical manner relative to the base.

5. The exercise device of claim 1, wherein the rotation assembly comprises a pulley belt configured to translate rotational movement from the crank assembly about the crank rotational axis to rotational movement of the flywheel about the flywheel rotational axis.

6. The exercise device of claim 1, wherein the rotation assembly further comprises a transfer assembly configured to transmit motion of the at least one crank to the flywheel assembly.

7. The exercise device of claim 6, wherein the rotation assembly further comprises a pulley assembly configured to transmit motion of the transfer assembly to the flywheel assembly.

8. The exercise device of claim 1, wherein the flywheel is positioned within the base.

9. The exercise device of claim 1, wherein a rotatable resistance of the flywheel is adjustable.

10. An exercise device comprising:
- a base; and
- a rotation assembly movably attached to the base and comprising:
  - an exercise interface assembly comprising at least one exercise support portion configured to be moved by a user,
  - a crank assembly comprising at least one crank rotatably attached to the at least one exercise support portion and configured to be rotated about a crank rotational axis by the at least one exercise support portion,
  - a flywheel assembly comprising a flywheel configured to be rotated about a flywheel rotational axis due to rotation of the at least one crank, wherein the crank rotational axis and the flywheel rotational axis are substantially perpendicular to each other,
  - a transfer assembly configured to transmit motion of the at least one crank to the flywheel assembly, and
  - a pulley assembly configured to transmit motion of the transfer assembly to the flywheel assembly, the pulley belt comprising:
    - a pulley belt configured to transfer rotational movement of a portion of the transfer assembly about a transfer rotational axis to rotational movement of a portion of the pulley assembly about a pulley rotational axis,
    - wherein the transfer rotational axis is substantially parallel to the crank rotational axis and substantially perpendicular to the flywheel rotational axis, and
    - wherein the pulley rotational axis is substantially parallel to the flywheel rotational axis and substantially perpendicular to the crank rotational axis.

11. The exercise device of claim 10, wherein the transfer assembly comprises a crankshaft, a drive wheel, and an idler wheel, wherein the drive wheel is fixed to the crankshaft, and the idler wheel is rotatably attached to the crankshaft, wherein the pulley belt extends along a portion of the drive wheel, a portion of the idler wheel, and a portion of a pulley hub of the pulley assembly.

12. The exercise device of claim 11, wherein, during use, the drive wheel and the idler wheel rotate in opposite directions.

13. The exercise device of claim 11, wherein the at least one crank is fixed to the crankshaft of the transfer assembly.

14. The exercise device of claim 11, wherein the transfer assembly comprises a rotatable pulley belt support that the pulley belt extends partially around and is configured to rotate as the pulley belt moves.

15. The exercise device of claim 14, wherein the rotatable pulley belt support is a tensioner pulley that is configured to adjust the tension of the pulley belt.

16. The exercise device of claim 15, wherein the tensioner pulley is movable relative to the crankshaft to change the tension of the pulley belt.

17. The exercise device of claim 10, wherein the crank assembly comprises a crankshaft that the at least one crank is fixed to, wherein the transfer assembly comprises a transfer belt that extends around a portion of the crankshaft and around a first end of a countershaft of the transfer assembly, wherein the pulley belt extends around a second end of the countershaft.

18. An exercise device comprising:

a base; and a rotation assembly movably attached to the base and comprising:

an exercise interface assembly comprising at least one exercise support portion configured to be moved by a user, a crank assembly comprising at least one crank rotatably attached to the at least one exercise support portion and configured to be rotated about a crank rotational axis by the at least one exercise support portion, and a flywheel assembly comprising a flywheel configured to be rotated about a flywheel rotational axis due to rotation of the at least one crank, wherein the crank rotational axis and the flywheel rotational axis are substantially perpendicular to each other, wherein a first end portion of the at least one exercise support portion is movable along at least a portion of the base, wherein the base defines a slot and the first end portion of the at least one exercise support portion comprises an extension that is configured to be received and move within the slot of the base, wherein a second end portion of the at least one exercise support portion is rotatably attached to the crank.

19. The exercise device of claim 18, wherein the rotation assembly further comprises a crankshaft that the at least one crank is configured to be fixed to, wherein the at least one crank is configured to be unlocked from and rotatable relative to the crankshaft.

* * * * *